United States Patent [19]

Miyazawa

[11] Patent Number: 5,024,313

[45] Date of Patent: Jun. 18, 1991

[54] COIN RETURN CONTROL SYSTEM FOR VENDING MACHINES

[75] Inventor: Tadashi Miyazawa, Tatebayashi, Japan

[73] Assignee: Sanden Coporation, Gunma, Japan

[21] Appl. No.: 430,171

[22] Filed: Nov. 1, 1989

[30] Foreign Application Priority Data

Nov. 2, 1988 [JP] Japan ..... 63-142682[U]
Nov. 11, 1988 [JP] Japan ..... 63-146676[U]
Nov. 11, 1988 [JP] Japan ..... 63-146677[U]

[51] Int. Cl.[5] ..... G07D 1/06
[52] U.S. Cl. ..... 194/217; 453/17
[58] Field of Search ..... 194/216, 217, 218; 453/16, 17

[56] References Cited

U.S. PATENT DOCUMENTS 4,462,512 7/1984 Schuller ..... 194/217

FOREIGN PATENT DOCUMENTS 0305290 3/1989 European Pat. Off. ..... 194/217

*Primary Examiner*—F. J. Bartuska
*Attorney, Agent, or Firm*—Banner, Birch, McKie & Beckett

[57] ABSTRACT

A coin return control system for vending machines including an apparatus for comparing the counted number of deposited smaller denomination coins with the number of the smaller denomination coins corresponding to a denomination of a larger denomination coin. The system returns the larger denomination coin or coins instead of the deposited smaller denomination coins only when the smaller denomination coin is in its change running-out state. Since the change running-out state of the smaller denomination coins which are useful for use of change is adequately canceled, this increases the chance of a vending machine sale greatly. Moreover, since the substitution of the larger denomination coin for the smaller denomination coins is carried out only when the smaller denomination coin is in its change running-out state, use of the vending machine as a coin exchange machine can be adequately prevented.

3 Claims, 20 Drawing Sheets

COIN RETURN CONTROL SYSTEM FOR VENDING MACHINES

BACKGROUND OF THE INVENTION 1. Field of the Invention

The present invention relates to a coin return control system for vending machines which returns coins from change retaining tubes instead of from deposited coins.

2. Description of the Prior Art

FIGS. 20 and 21 illustrate two types of conventional coin return control systems In the control systems, a coin deposited into a coin inlet 1 is guided along a coin guide path 2, and tested by a coin testing means 3 to determine its authenticity and type during its passage through the coin guide path. A coin determined to be an unacceptable coin (for example, a metal slug or foreign coin) is distributed to a first coin path 5 by a distributing gate means 4 and returned through a slug chute 10 to a return opening 11.

When a deposited coin is an acceptable coin, and when it is determined to be a five hundred monetary unit coin, it is distributed to a second coin path 6; when it is determined to be a ten unit coin, it is distributed to a third coin path 7; when it is determined to be a fifty unit coin, it is distributed to a fourth coin path 8; and when it is determined to be a one hundred unit coin, it is distributed to a fifth coin path 9, respectively. The deposited coins thus distributed are guided through respective coin paths 6, 7, 8 and 9 and retained in a change retaining tube 12 for five hundred unit coins, a change retaining tube 13 for ten unit coins, a change retaining tube 14 for fifty unit coins and a change retaining tube 15 for one hundred unit coins, respectively.

In the system shown in FIG. 20, after coin testing means 3 determines the type of deposited acceptable coins, the determining signal $DS_{500}$ which represents the determination of five hundred unit coin is input to a deposited coin number counter $CT_{500}$ for five hundred unit coins; the determining signal $DS_{10}$ represents the determination of ten unit coin is input to a deposited coin number counter $CT_{10}$ for ten unit coins; the determining signal $DS_{50}$ which represents the determination of fifty unit coin is input to a deposited coin number counter $CT_{50}$ and the determining signal $DS_{100}$ which represents the determination of one hundred unit coin is input to a deposited coin number counter $CT_{100}$, respectively. By these inputs, the number of deposit coins in accordance with the type of the deposited coins is counted by each of deposited coin number counters $CT_{500}$, $CT_{10}$, $CT_{50}$ and $CT_{100}$.

In the system shown in FIG. 21, the determining signals $DS_{500}$, $DS_{10}$, $DS_{50}$ and $DS_{100}$ are also input to a stored coin number counter $MS_{500}$ for five hundred unit coins, a stored coin number counter $MS_{10}$ for ten unit coins, a stored coin number counter $MS_{50}$ for fifty unit coins and a stored coin number counter $MS_{100}$ for one hundred unit coins, respectively. The counted numbers are added to predetermined initial values represent values) in stored coin number counters $MS_{500}$, $MS_{10}$, $MS_{50}$ and $MS_{100}$, respectively. Stored coin number counters $MS_{500}$, $MS_{10}$, $MS_{50}$ and $MS_{100}$ are preset to respective predetermined initial values by input of change running-out detecting signals $E_{500}$, $E_{10}$, $E_{50}$ and $E_{100}$ sent from change running-out detecting means 12*a*, 13*a*, 14*a* and 15*a* provided on respective change retaining tubes 12, 13, 14 and 15. For example, change running-out detecting means 12*a* for five hundred unit coins detects the change running-out state when the number of five hundred unit coins retained in change retaining tube 12 reaches two, and stored coin number counter $MS_{500}$ is set to the preset value "2". Change running-out detecting means 13*a* for ten unit coins detects the change running-out state when the number of ten unit coins retained in change retaining tube 13 reaches twelve, and stored coin number counter $MS_{10}$ is set to the preset value "12". Change running-out detecting means 14*a* and 15*a* for fifty unit coins and one hundred unit coins detect the respective change running-out states when the number of either the fifty unit coins or the one hundred unit coins retained in change retaining tubes 14 and 15 reach ten, and respective stored coin number counters $MS_{50}$ and $MS_{100}$ are set to the preset value "10".

In these systems, when a return signal RS for deposited coins generated by a return signal generating means 100 (for example, a coil return lever) is input to a coin return control unit 17, the coin return control unit outputs paying-out signals $P_{500}$, $P_{10}$, $P_{50}$ and $P_{100}$ to a coin paying-out mechanism 16 according to counting signals $C_{500}$, $C_{10}$, $C_{50}$ and $C_{100}$ which represent counted numbers of respective deposited coin number counters $CT_{500}$, $CT_{10}$, $CT_{50}$ and $CT_{100}$ and detecting signals $E_{500}$, $E_{10}$, $E_{50}$ and $E_{100}$ of respective change running-out detecting means 12*a*, 13*a*, 14*a* and 15*a* (FIG. 20) (and stored number counting signals $M_{500}$, $M_{10}$, $M_{50}$ and $M_{100}$ which represent counted numbers of respective stored coin number counters $MS_{500}$, $MS_{10}$, $MS_{50}$ and $MS_{100}$ (FIG. 21)), for example so as to return the same type and number as the type and number of the deposited coins. Coin paying-out mechanism 16 returns coins, which are the same type and number as the type and number of the deposited coins, from respective change retaining tubes 12, 13, 14 and 15.

In the system shown in FIG. 21, the paying-out signals $P_{500}$, $P_{10}$, $P_{50}$ and $P_{100}$ are also input to corresponding stored coin number counters $MS_{500}$, $MS_{10}$, $MS_{50}$ and $MS_{100}$, respectively. Respective stored coin number counters $MS_{500}$, $MS_{10}$, $MS_{50}$ and $MS_{100}$ subtract the corresponding paying-out number from the stored number when paying-out signals $P_{500}$, $P_{10}$, $P_{50}$ and $P_{100}$ are input, and then, count the present number of the coins retained in respective change retaining tubes 12, 13, 14 and 15, and hold the present counted numbers.

On the other hand, a conventional coin return control system wherein coins are returned by a minimum number of coins is known. For example, when twelve ten unit coins are deposited, the system returns a one hundred unit coin and two ten unit coins.

However, in the systems shown in FIGS. 20 and 21, when a smaller denomination coin which is frequently utilized for change is in its change running-out state, for example, when change running-out detecting means 13*a* detects the change running-out state of ten unit coins in change retaining tube 13, the change running-out state is canceled only when the smaller denomination coins are deposited, but the smaller denomination coin is again in its change running-out state after the coins are returned. In such a condition, since the change running-out state is not really canceled until a manager for the vending machine supplements the coins for change, the probability that the chance of sale is missed is very high.

In the systems that return a minimum number of coins, there is a drawback in that the vending machine can be used as coin exchange machine.

SUMMARY OF THE INVENTION

Accordingly, an object of the present invention is to provide a coin return control system which can certainly cancel the change running-out state of a smaller denomination coin which is in its change running-out state, thereby maximizing the chance of a vending machine sale.

To achieve this and other objects, the following coin return control systems for vending machines are provided according to the present invention.

A first coin return control system according to the present invention comprises:

a coin testing means for determining the authenticity and type of deposited coins;

a plurality of deposited coin number counters each of which counts the number of a corresponding type of the deposited coins according to the determining signals from the coin testing means;

a plurality of change retaining tubes each of which retains a corresponding type of the deposited coins;

a coin paying-out mechanism which pays out coins from the change retaining tubes according to paying-out signals;

a plurality of change running-out detecting means each of which detects that the number of coins retained in a corresponding change retaining tube has reached a number not less than a predetermined number and outputs the detecting signal;

a return signal generating means which generates a return signal for returning the deposited coins;

a comparison means for comparing the counted number of smaller denomination coins by a corresponding deposited coin number counter with the number of the smaller denomination coins corresponding to a denomination of a larger denomination coin, and outputting a control signal if the counted number is not less than the number corresponding to the denomination of the larger denomination coin; and a coin return control unit for setting a paying-out signal so as to return the larger denomination coin instead of the smaller denomination coins if the detecting signal with the smaller denomination coin by the corresponding change running-out detecting means is input, the control signal is input and the detecting signal with the larger denomination coin by the another corresponding change running-out detecting means is not input, when the return signal is input, and outputting the paying-out signal to the coin paying-out mechanism.

A second coin return control system according to the present invention comprises:

a coin testing means for determining the authenticity and type of deposited coins;

a plurality of deposited coin number counters each of which counts the number of a corresponding type of the deposited coins according to the determining signals from the coin testing means;

a plurality of change retaining tubes each of which retains a corresponding type of the deposited coins;

a coin paying-out mechanism which pays out coins from the change retaining tubes according to paying-out signals;

a plurality of change running-out detecting means each of which detects that the number of coins retained in a corresponding change retaining tube reaches a number not less than a predetermined number and outputs the detecting signal;

a plurality of stored coin number counters each of which is set to a predetermined initial value by input of the detecting signal of a corresponding change running-out detecting means, adds the number of coins deposited into a corresponding change retaining tube to the prior number of coins retained in the change detaining tube by input of the determining signal, and subtracts the number of coins paid out by the coin paying-out mechanism from the prior number of coins retained in the change retaining tube by input of the paying-out signal;

a return signal generating means which generates a return signal for returning the deposited coins;

a first comparison means for comparing the counted number of smaller denomination coins by a corresponding deposited coin number counter with the number of the smaller denomination coins corresponding to a denomination of a larger denomination coin, and outputting a first control signal if the counted number is not less than the number corresponding to the denomination of the larger denomination coin;

a second comparison means for comparing the number counted by a stored coin number counter with the predetermined initial value of the stored coin number counter, and outputting a second control signal if the counted number is greater than the initial value;

a coin return control unit for setting a paying-out signal so as to return the larger denomination coin instead of the smaller denomination coins if the detecting signal with the smaller denomination coin by the corresponding change running-out detecting means is input, the first control signal is input and the second control signal with the larger denomination coin compared with the smaller denomination coins is input, when the return signal is input, and outputting the paying-out signal to the coin paying-out mechanism and the stored coin number counters.

A third coin return control system according to the present invention comprises:

a coin testing means for determining the authenticity and type of deposited coins;

a plurality of deposited coin number counters each of which counts the number of a corresponding type of the deposited coins according to the determining signals from the coin testing means;

a plurality of change retaining tubes each of which retains a corresponding type of the deposited coins;

a coin paying-out mechanism which pays out coins from the change retaining tubes according to paying-out signals;

a plurality of change running-out detecting means each of which detects that the number of coins retained in a corresponding change retaining tube reaches a number not less than a predetermined number and outputs the detecting signal;

a plurality of stored coin number counters each of which is set to a predetermined initial value by input of the detecting signal of a corresponding change running-out detecting means, adds the number of coins deposited into a corresponding change retaining tube to the prior number of coins retained in the change detaining tube by input of the determining signal, and subtracts the number of coins paid out by the coin paying-out mechanism from the prior number of coins retained in the change retaining tube by input of the paying-out signal;

a return signal generating means which generates a return signal for returning the deposited coins;

a plurality of change running-out memory means each of which memorizes the change running-out state of a corresponding change running-out detecting means is input, when the counted numbers of all the deposited coin number counters are their initial values;

a first comparison means for comparing the counted number of smaller denomination coins by a corresponding deposited coin number counter with the number of the smaller denomination coins corresponding to a denomination of a larger denomination coin, and outputting a first control signal if the counted number is not less than the number corresponding to the denomination of the larger denomination coin;

a second comparison means for comparing the number counted by a stored coin number counter with the predetermined initial value of the stored coin number counter, and outputting a second control signal if the counted number is greater than the initial value;

a coin return control unit for setting a paying-out signal so as to return the larger denomination coin instead of the smaller denomination coins if the change running-out memory means memorizes the change running-out state of the smaller denomination coin, the first control signal is input and the second control signal with the larger denomination coin compared with the smaller denomination coins is input, when the return signal is input, outputting the paying-out signal to the coin paying-out mechanism and the stored coin number counters, and outputting the addition and subtraction signals to the corresponding stored coin number counter and the corresponding deposited coin number counter so as to add the number of the smaller denomination coins substituted by the larger denomination coin to the stored coin number counter for the smaller denomination coins and subtract the number from the corresponding deposited coin number counter.

In the above-described first coin return control system, when a smaller denomination coin is in its change running-out state and coins are deposited in this state, if the number of the smaller denomination coins deposited by a customer and counted by the deposited coin number counter is determined to be not less than the number corresponding to the denomination of a larger denomination coin by the comparison means and the number of the larger denomination coins retained in the change retaining tube is greater than the predetermined number to be detected by the change running-out detecting means, one larger denomination coin is returned to the customer instead of the deposited smaller denomination coins via the control of the coin return control unit. Therefore, the change running-out state of the smaller denomination coin which is more frequently utilized as change can be certainly canceled by the substitution of the larger denomination coin for the smaller denomination coins, thereby increasing the chance of a sale by the vending machine. Moreover, since the above substitution is performed only when the specific condition is satisfied, the number of cases that result in the vending machine being used as a coin exchange machine can be decreased.

In the second coin return control system, the stored coin number counters are provided and the first and second control signals by the first and second comparison means are used for the coin return control by the coin return control unit. When a smaller denomination coin is in its change running-out state and coins are deposited in this state, if the number of the smaller denomination coins deposited by a customer and counted by the deposited coin number counter is determined to be not less than the number of coins corresponding to the denomination of a larger denomination coin by the first comparison means and the number of the larger denomination coins retained in the change retaining tube and counted by the stored coin number counter is determined to be greater than the predetermined initial value preset in the stored coin number counter, the larger denomination coin is returned to the customer instead of the deposited smaller denomination coins via the control of the coin return control unit. Therefore, the change running-out state of the smaller denomination coin can be certainly canceled and the vending machine can be adequately prevented from being utilized as a coin exchange machine.

In the third coin return control system, change running-out memory means are further provided, and the change running-out state of each type of coin is memorized. When a smaller denomination coin is in its change running-out state, this state is memorized by the corresponding change running-out memory means. When coins are deposited by a customer in this state, if the number of the deposited smaller denomination coins counted by the deposited coin number counter is determined to be not less than the number corresponding to the denomination of a larger denomination coin by the first comparison means and the number of the larger denomination coins retained in the change retaining tube and counted by the stored coin number counter is determined to be greater than the predetermined initial value preset in the stored coin number counter, the larger denomination coin is returned to the customer instead of the deposited smaller denomination coins via the control of the coin return control unit under the condition that the change running-out state of the smaller denomination coin is memorized. Therefore, the change running-out state of the smaller denomination coin can be more certainly canceled and the vending machine can be adequately prevented from being utilized as a coin exchange machine.

BRIEF DESCRIPTION OF THE DRAWINGS

Preferred exemplary embodiments of the present invention will now be described with reference to the accompanying drawings which are given by way of example only. The invention is only limited by the claims appended hereto.

DETAILED DESCRIPTION OF THE PREFERRED EMBODIMENTS OF THE PRESENT INVENTION

Figure 1:
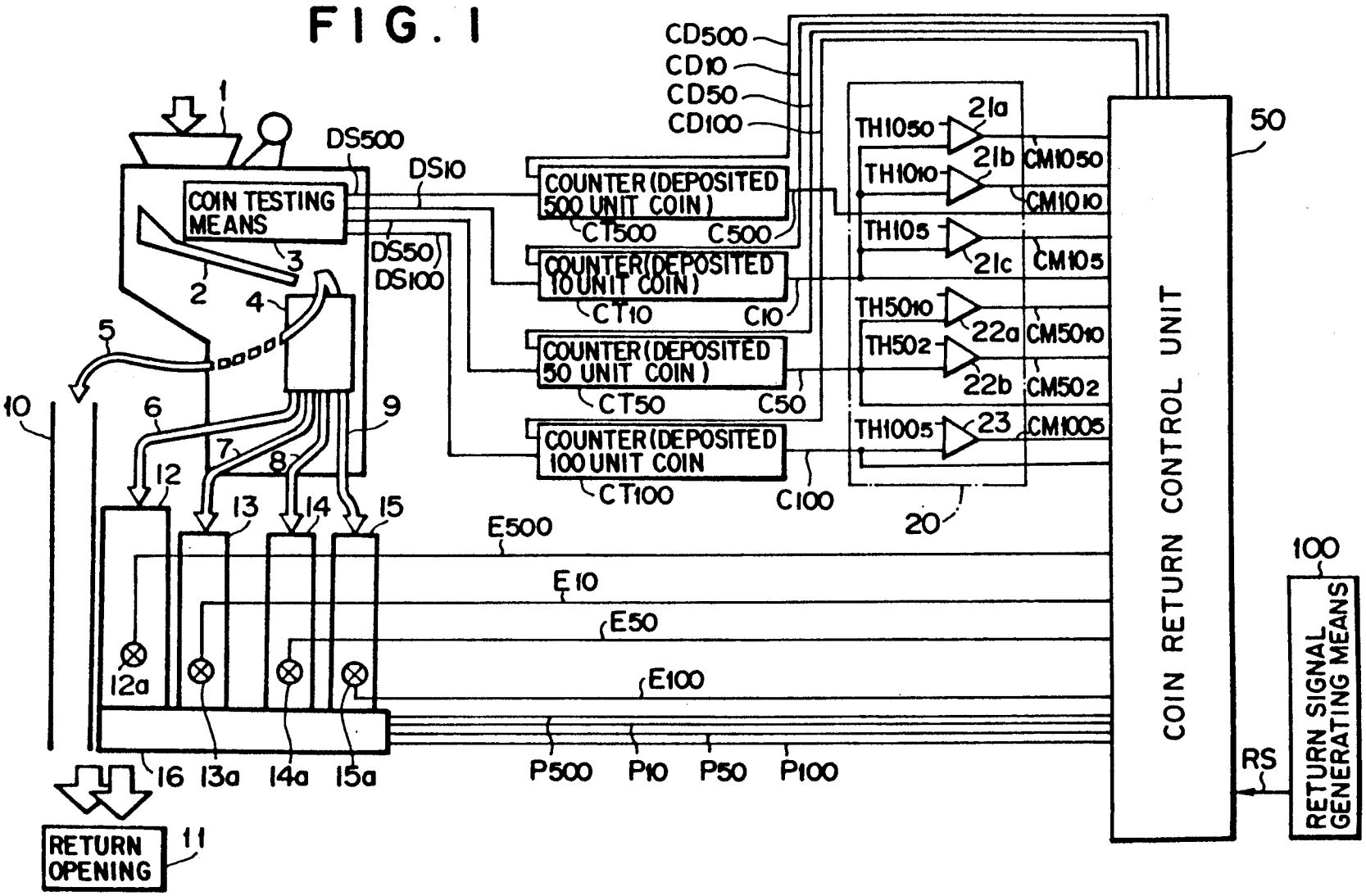
FIG. 1 is a schematic view of a coin return control system according to a first embodiment of the present invention.
Figure 20:
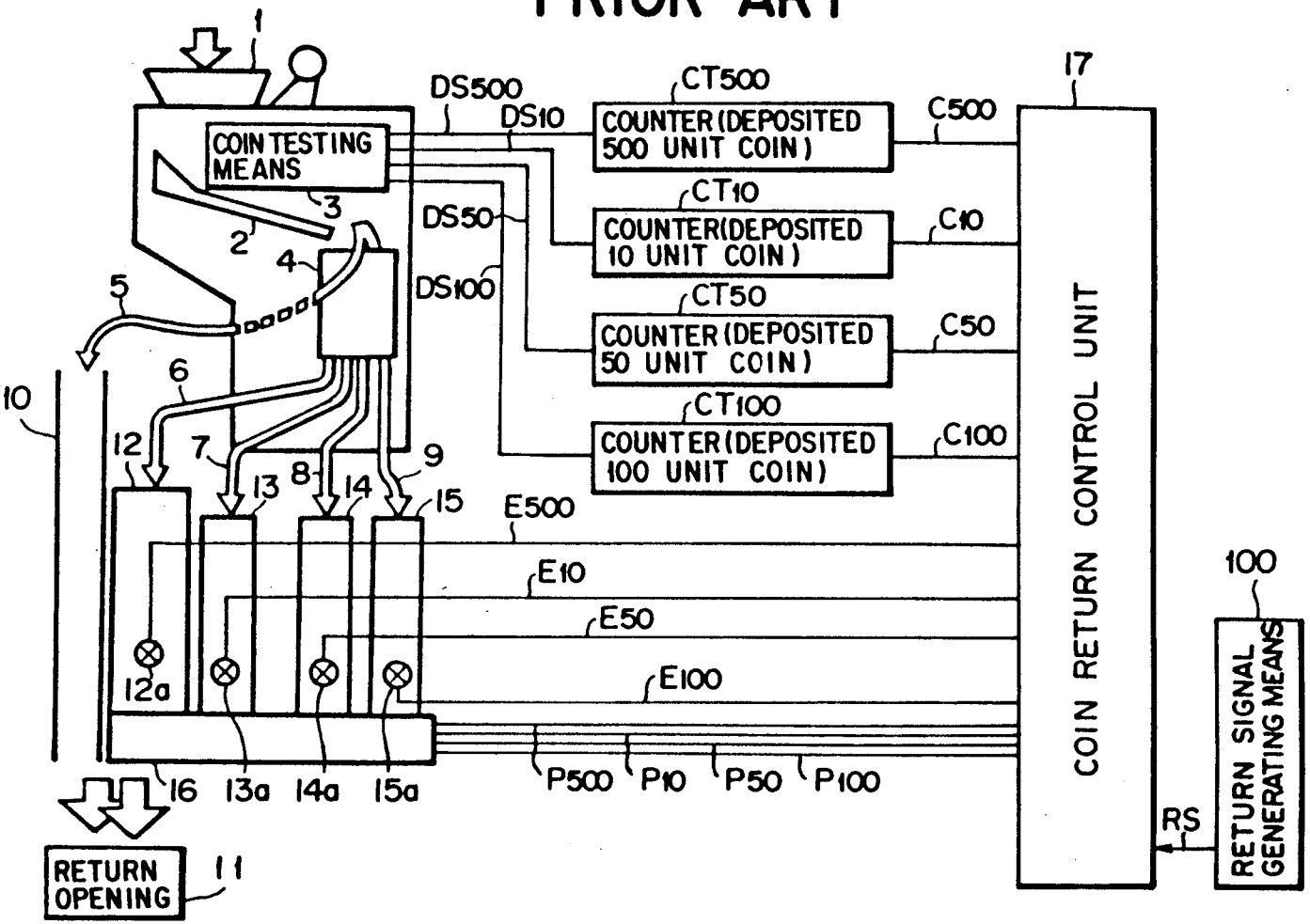
FIG. 20 PRIOR ART
FIG. 20 is a schematic view of a conventional coin return control system.
Figure 21:
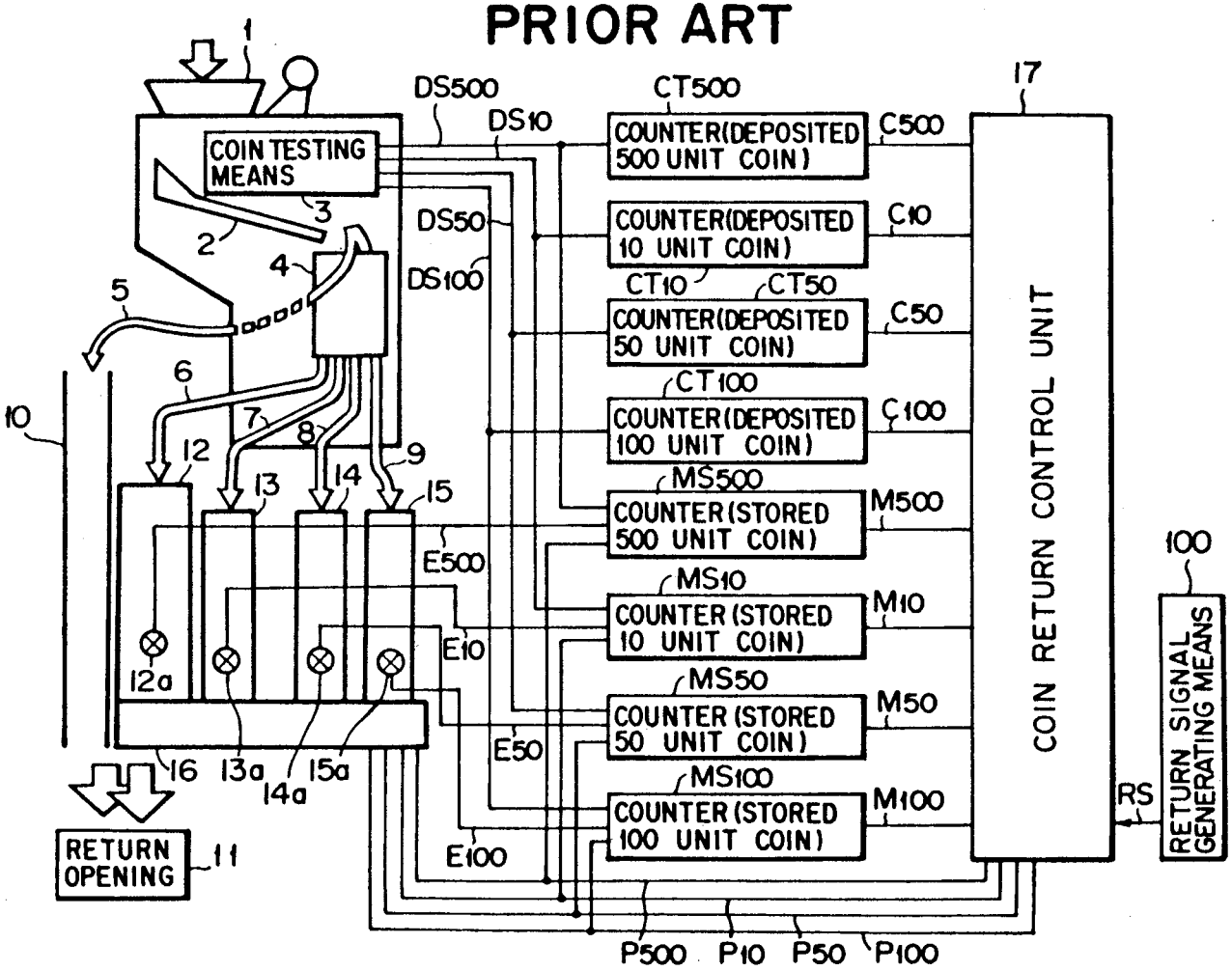
FIG. 21 PRIOR ART
FIG. 21 is a schematic view of another conventional coin return control system.

Referring to the drawings, FIGS. 1–6 illustrate a first embodiment of the present invention. In FIG. 1, elements corresponding to elements of the conventional coin return control system shown in FIG. 20 are identified by the same symbols as those in FIG. 20. Coins deposited into a coin inlet 1 are guided along a coin guide path 2, and a coin testing means 3 determines the authenticity and type of the deposited coins during their passage through the coin guide path. Coins determined to be unacceptable coins by coin testing means 3 are distributed to a first coin path 5 by a distributing gate means 4 and returned through a slug chute 10 to a return opening 11. Coins determined to be acceptable coins by coin testing means 3 are distributed to a second coin path 6, a third coin path 7, a fourth coin path 8 and a fifth coin path 9 by distributing gate means 4, respectively, in accordance with the type of coins. The coins from respective coin paths 6, 7, 8 and 9 are guided to and retained in corresponding change retaining tube 12 for five hundred unit coins, change retaining tube 13 for ten unit coins, change retaining tube 14 for fifty unit coins and change retaining tube 15 for one hundred unit coins each of which communicate with a coin paying-out mechanism 16. A change running-out detecting means 12*a* provided on change retaining tube 12 detects the change running-out state of the five hundred unit coins retained in the tube and outputs a detecting signal $E_{500}$ when the number of the retained coins reaches two for example. A change running-out detecting means 13*a* provided on change retaining tube 13 detects the change running-out state of the ten unit coins retained in that tube and outputs a detecting signal $E_{10}$ when the number of the retained coins reaches twelve. Change running-out detecting means 14*a* and 15*a* provided on change retaining tubes 14 and 15 detect the change running-out states of the fifty unit coins and the one hundred unit coins retained in those tubes, respectively, and output detecting signals $E_{50}$ and $E_{100}$ when the number of either type of coin retained the corresponding tube reaches ten. Coin paying-out 16 pays out coins from change retaining tubes 12, 13, 14 and 15 to return opening 11 under control of paying-out signals $P_{500}$, $P_{10}$, $P_{50}$ and $P_{100}$ sent from a coin return control unit 50.

A deposited coin number counter $CT_{500}$ for five hundred unit coins counts the number of deposited five hundred unit coins by input of determining signals $DS_{500}$ from coin testing means 3, and subtracts a number from the counted number by input of a subtraction signal $CD_{500}$ from coin return control unit 50. A deposited coin number counter $CT_{10}$ for ten unit coins counts the number of deposited ten unit coins by input of determining signals $DS_{10}$ from coin testing means 3, and subtracts a number from the counted number by input of a subtraction signal $CD_{10}$ from coin return control unit 50. A deposited coin number counter $CT_{50}$ for fifty unit coins counts the number of deposited fifty unit coins by input of determining signals $DS_{50}$ from coin testing means 3, and subtracts a number from the counted number by input of a subtraction signal $CD_{50}$ from coin return control unit 50. A deposited coin number counter $CT_{100}$ for one hundred unit coins counts the number of deposited one hundred unit coins by input of determining signals $DS_{100}$ from coin testing means 3, and subtracts a number from the counted number by input of a subtraction signal $CD_{100}$ from coin return control unit 50.

A comparison means 20 compares counting signals $C_{10}$, $C_{50}$ and $C_{100}$ which represent the counted numbers of respective deposited coin number counters $CT_{10}$, $CT_{50}$ and $CT_{100}$ with the threshold numbers of the respective smaller denomination coins corresponding to denominations of respective larger denomination coins, and outputs control signals if the respective counted numbers are not less than the corresponding threshold numbers.

More specifically, a comparator 21*a* compares counting signal $C_{10}$ representing the counted number of deposited coins by counter $CT_{10}$ for ten unit coins with a threshold number $TH10_{50}$ (e.g. 50, the number of ten unit coins corresponding to the denomination of a five hundred unit coin), and outputs a control signal $CM10_{50}$ if $C_{10}$ is not less than threshold number of 50. A comparator 21*b* compares counting signal $C_{10}$ with a threshold number $TH10_{10}$ (e.g. 10, the number of ten unit coins corresponding to the denomination of a one hundred unit coin), and outputs a control signal $CM10_{10}$ if $C_{10}$ is not less than the threshold number of 10. A comparator 21*c* compares counting signal $C_{10}$ with a threshold number $TH10_5$ (e.g. 5, the number of ten unit coins corresponding to the denomination of a fifty unit coin), and outputs a control signal $CM10_5$ if $C_{10}$ is not less than the threshold number of 5.

A comparator 22*a* compares counting signal $C_{50}$ representing the counted number of deposited coin number counter $CT_{50}$ for fifty unit coins with a threshold number $TH50_{10}$ (e.g. 10, the number of fifty unit coins corresponding to the denomination of a five hundred unit coin), and outputs a control signal $CM50_{10}$ if $C_{50}$ is not less than the threshold number of 10. A comparator 22*b* compares counting signal $C_{50}$ with a threshold number $TH50_2$ (e.g. 2, the number of fifty unit coins corresponding to the denomination of a one hundred unit coin), and outputs a control signal $CM50_2$ if $C_{50}$ is not less than the threshold number of 2.

A comparator 23 compares counting signal $C_{100}$ representing the counted number of deposited coin number counter $CT_{100}$ for one hundred unit coins with a threshold number $TH100_5$ (e.g. 5, the number of one hundred unit coins corresponding to the denomination of a five hundred unit coin), and outputs a control signal $CM100_5$ if $C_{100}$ is not less than the threshold number of 5.

A coin return control unit 50 sets paying-out signals $P_{500}$, $P_{10}$, $P_{50}$ and $P_{100}$ representing the numbers of the respective types of coins to be paid out (returned) in accordance with input of detecting signals $E_{500}$, $E_{10}$, $E_{50}$ and $E_{100}$ of change running-out detecting means 12*a*, 13*a*, 14*a* and 15*a* and counting signals $C_{500}$, $C_{10}$, $C_{50}$ and $C_{100}$ by deposited coin number counters $CT_{500}$, $CT_{10}$, $CT_{50}$ and $CT_{100}$, respectively, when return signal RS is input into the unit from a return signal generating means 100. Control unit 50 and outputs subtraction signal $CD_{500}$ to deposited coin number counter $CT_{500}$, subtraction signal $CD_{10}$ to deposited coin number counter $CT_{10}$, subtraction signal $CD_{50}$ to deposited coin number counter $CT_{50}$ and subtraction signal $CD_{100}$ to deposited coin number $CT_{100}$, respectively. Further, coin return control 50 sets paying-out signals $P_{500}$, $P_{10}$, $P_{50}$ and $P_{100}$ so as pay out (return) relatively larger denomination coins instead of the relatively smaller denomination coins if, when return signal RS is input, at least one of detecting signals $E_{10}$, $E_{50}$ and $E_{100}$ of change running-out detecting means 13a, 14a and 15a is input, at least one of control signals $CM10_{50}$, $CM10_{10}$, $CM10_5$, $CM50_{10}$, $CM50_2$ and $CM100_5$ of comparators 21a, 21b, 21c, 22a, 22b and 23 is input; one or more of the detecting signal $E_{500}$, $E_{50}$ or $E_{100}$ is not input; and outputs the paying-out signals to coin paying-out mechanism 16.

The operation of the system shown in FIG. 1 will now be explained with reference to flowcharts shown in FIGS. 2–6. Here, deposited coins are all assumed for simplicity to be acceptable coins.

First, it is determined by coin testing means 3 whether each of five hundred unit coins, one hundred unit coins, fifty unit coins and ten unit coins is deposited (steps 101–104). If the deposited coin is determined to be a five hundred unit coin at step 101, determining signal $DS_{500}$ is input to deposited coin number counter $CT_{500}$ for five hundred unit coins and the count in counter $CT_{500}$ is incremented by one (step 105). The five hundred unit coin is distributed to second coin path 6 by distributing gate means 4 and sent to and retained in change retaining tube 12 for five hundred unit coins (step 106), and control returns to step 101.

If the deposited coin is determined not to be a five hundred unit coin at step 101 but is determined to be a one hundred unit coin at step 102, determining signal $DS_{100}$ is input to deposited coin number counter $CT_{100}$ for one hundred unit coins and the count in that counter is incremented by one (step 107). The one hundred unit coin is distributed to fifth coin path 9 by distributing gate means 4 and sent to and retained in change retaining tube 15 for one hundred unit coins (step 108), and control returns to step 101.

If the deposited coin is determined not to be a five hundred or one hundred unit coin at steps 101 and 102 but is determined to be a fifty unit coin at step 103, determining signal $DS_{50}$ is input to deposited coin number counter $CT_{50}$ for fifty unit coins and the count in that counter is incremented by one (step 109). The fifty unit coin is distributed to fourth coin path 8 by distributing gate means 4 and sent to and retained in change retaining tube 14 for fifty unit coins step 110), and control returns to step 101.

If the deposited coin is determined not to be a five hundred, one hundred or fifty unit coin at steps 101–103 but is determined to be a ten unit coin at step 104, determining signal $DS_{10}$ is input to deposited coin number counter $CT_{10}$ for ten unit coins and the count in that counter is incremented by one (step 111). The ten unit coin is distributed to third coin path 7 by distributing gate means 4 and sent to and retained in change retaining tube 13 for ten unit coins (step 112), and control returns to step 101.

If it is determined at steps 101–104 that no coin of any type is deposited, coin return control unit 50 determines whether return signal RS is generated by operation of return signal generating means 100 (step 113). If return signal RS is generated, control proceeds to the coin return control portion of the flow diagram as shown in FIGS. 3–6.

Coin return control unit 50 determines by counting signal $C_{500}$ for five hundred unit coins whether the counted number of the deposited coin number counter is zero (step 114). If the counted number is determined to be zero at step 114, it is determined whether detecting signal $E_{500}$ of change running-out detecting means 12a for five hundred unit coins is input (step 115). If it is determined at step 115 that detecting signal $E_{500}$ is not input, it is determined whether detecting signal $E_{100}$ of change running-out detecting means 15a for one hundred unit coins is input (step 116).

If detecting signal $E_{100}$ is determined to be present at step 116, it is determined whether the counted number of deposited coin number counter $CT_{100}$ is not less than threshold number $TH100_5$ (=5) and therefore whether control signal $CM100_5$ of comparator 23 of comparison means 20 is input or not (step 117).

If it is determined that detecting signal $E_{100}$ is not input at step 116 or that control signal $CM100_5$ is not input at step 117, it is determined whether detecting signal $E_{50}$ of change running-out detecting means 14a for fifty unit coins is input (step 118). If detecting signal $E_{50}$ is input, it is determined whether the counted number of deposited coin number counter $CT_{50}$ is not less than threshold number $TH50_{10}$ (=10) and therefore whether control signal $CM10_{10}$ of comparator 22a is input (step 119).

If it is determined that detecting signal $E_{50}$ is not input at step 118 or that control signal $CM50_{10}$ is not input at step 119, it is determined whether detecting signal $E_{10}$ of change running-out detecting means 13a for ten unit coins is input (step 120). If detecting signal $E_{10}$ is input, it is determined whether the counted number of deposited coin number counter $CT_{10}$ is not less than threshold number $TH10_{50}$ (=50) and control signal $CM10_{50}$ of comparator 21a is input (step 121).

On the other hand, if it is determined that the counted number of deposited coin number counter $CT_{500}$ is not zero at step 114, that control signal $CM100_5$ is input at step 117, that control signal $CM50_{10}$ is input at step 119, or that control signal $CM10_{50}$ is input at step 121, coin return control unit 50 outputs paying-out signal $P_{500}$ to coin paying-out mechanism 16. According to this $P_{500}$ signal, a five hundred unit coin is returned from five hundred unit coin retaining tube 12 to return opening 11 (step 122).

Thereafter, it is determined whether the counted number of deposited coin number counter $CT_{500}$ for five hundred unit coins is zero (step 123). If the counted number is determined not to be zero, subtraction signal $CD_{500}$ is output to deposited coin number counter $CT_{500}$ to subtract one from the count. This causes deposited coin number counter $CT_{500}$ to be decremented by one (step 124), and control returns to step 114.

If the counted number of deposited coin number counter $CT_{500}$ is determined to be zero at step 123, it is determined whether control signal $CM100_5$ is input (step 125) If control signal $CM100_5$ is input, subtraction signal $CD_{100}$ is output to deposited coin number counter $CT_{100}$ to subtract five from the counted number. This causes deposited coin number counter $CT_{100}$ to be decremented by five (step 126), and control returns to step 114.

If control signal $CM100_5$ is determined not to be input at step 125, it is determined whether control signal $CM50_{10}$ is input (step 127). If control signal $CM50_{10}$ is input, subtraction signal $CD_{50}$ is output to deposited coin number counter $CT_{50}$ to subtract ten from the counted number. This causes deposited coin number counter $CT_{50}$ to be decremented by ten (step 128). and control returns to step 114.

If control signal $CM50_{10}$ is determined not to be input at step 127, subtraction $CD_{10}$ is output to deposited coin number counter $CT_{10}$ to subtract fifty from the counted number. This causes deposited coin number counter $CT_{10}$ to be decremented by fifty (step 129), and control returns to step 114.

Figure 4:
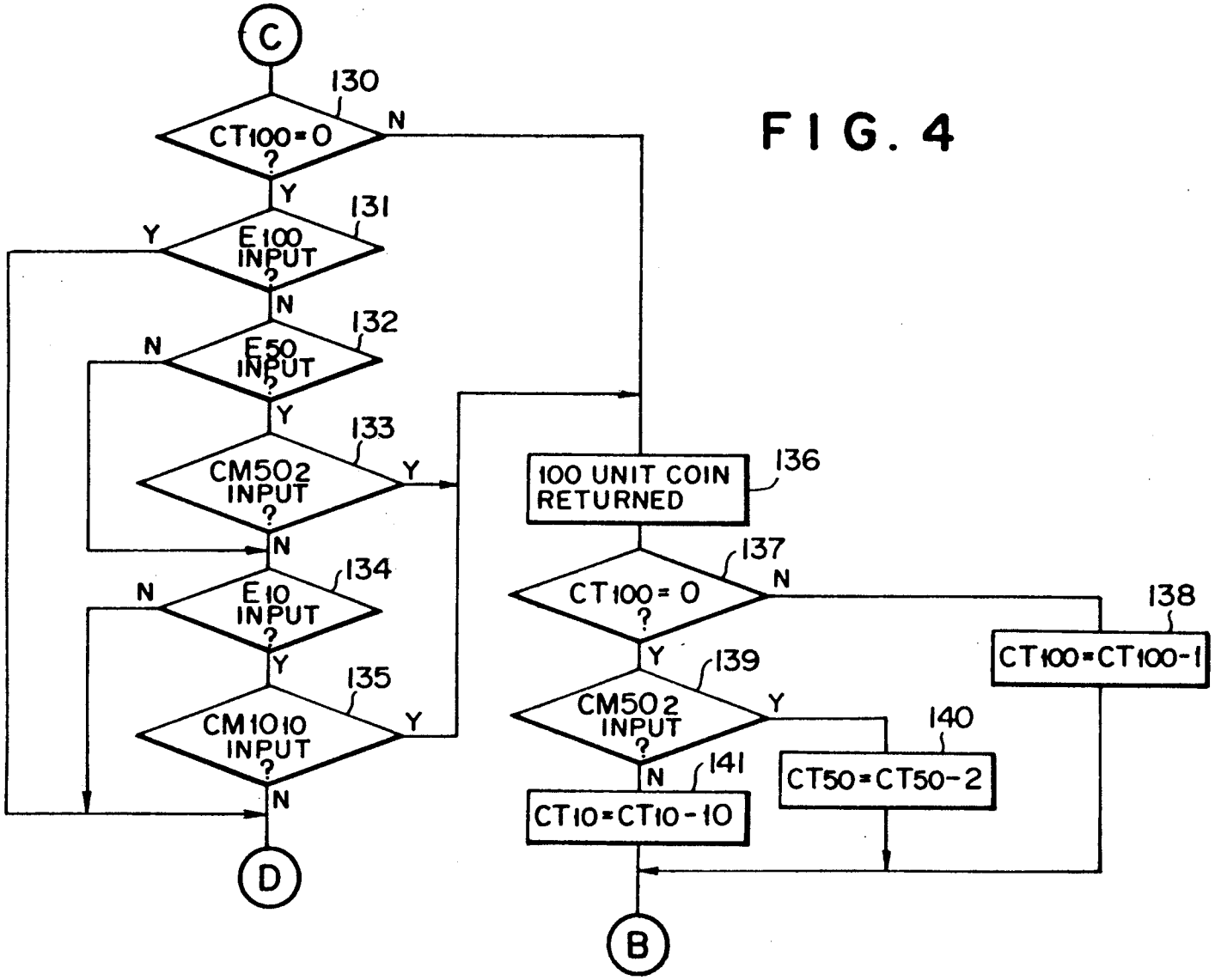

If it is determined that detecting signal $E_{500}$ is input at step 115, that detecting signal $E_{10}$ is not input at step 120, or that control signal $CM10_{50}$ is not input at step 121, control proceeds to the operation shown in FIG. 4 beginning with step 130.

Coin return control unit 50 determines whether the counted number of deposited coin number counter $CT_{100}$ is zero or not, by counting sign $C_{100}$ of the deposited coin number counter (step 130). If the counted number is determined to be zero at step 130, it is determined whether detecting signal $E_{100}$ of change running-out detecting means 15*a* for one hundred unit coins is input (step 131). If detecting signal $E_{100}$ is not input at step 131, it is determined whether detecting signal $E_{50}$ of change running-out detecting means 14*a* for fifty unit coins is input (step 132).

If detecting signal $E_{50}$ is determined to be input at step 132, it is determined whether the counted number of deposited coin number counter $CT_{50}$ for fifty unit coins is not less than threshold number $TH50_2$ (=2) and therefore that control signal $CM50_2$ of comparator 22*b* of comparison means 20 is input (step 133).

If it is determined that detecting signal $E_{50}$ is not input at step 132 or that control signal $CM50_2$ is not input at step 133, it is determined whether detecting signal $E_{10}$ of change running-out detecting means 13*a* for ten unit coins is input (step 134). If detecting signal $E_{10}$ is determined to be input at step 134, it is determined whether the counted number of deposited coin number counter $CT_{10}$ for ten unit coins is not less than threshold number $TH10_{10}$ (=10) and therefore that control signal $CM10_{10}$ of comparator 21*b* of comparison means 20 is input (step 135).

Figure 5:
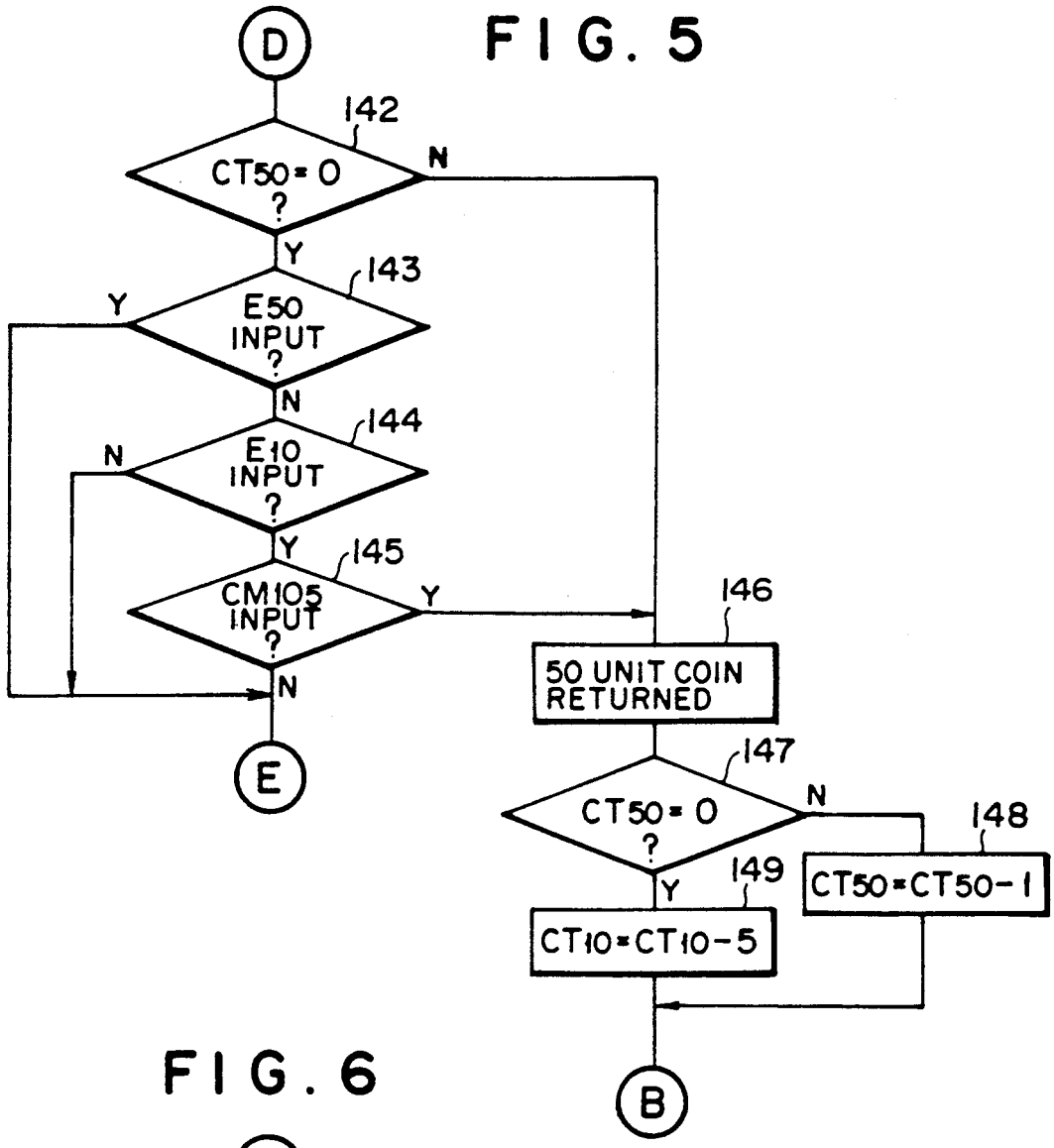

If it is determined that control signal $CM10_{10}$ is not input at step 135, that detecting signal $E_{100}$ is input at step 131, or that detecting signal $E_{10}$ is not input at step 134, control proceeds to the operation shown in FIG. 5 beginning at step 142.

On the other hand, if it is determined that the counted number of deposited coin number counter $CT_{100}$ is not zero at step 130, that control signal $CM50_2$ is input at step 133, or that control signal $CM10_{10}$ is input at step 135, coin return control unit 50 outputs paying-out signal $P_{100}$ to coin paying-out mechanism 16. According to this $P_{100}$ signal, a one hundred unit coin is returned from one hundred unit coin retaining tube 15 to return opening 11 (step 136).

Thereafter, it is determined whether the counted number of deposited coin number counter $CT_{100}$ for one hundred unit coins is zero (step 137). If the counted number is determined not to be zero, subtraction signal $CD_{100}$ is output to deposited coin number counter $CT_{100}$ to subtract one from the counted number. This causes deposited coin number counter $CT_{100}$ to be decremented by one (step 138), and control returns to step 114 shown in FIG. 3.

If the counted number of deposited coin number counter $CT_{100}$ is determined to be zero at step 137, it is determined whether control signal $CM50_2$ is input (step 139). If control signal $CM50_2$ is input, subtraction signal $CD_{50}$ is output to deposited coin number counter $CT_{50}$ to subtract two from the counted number. This causes deposited coin number counter $CT_{50}$ to be decremented by two (step 140), and control returns to step 114.

If control signal $CM50_2$ is determined not to be input at step 139, subtraction signal $CD_{10}$ is output to deposited coin number counter $CT_{10}$ to subtract ten from the counted number. This causes deposited coin number counter $CT_{10}$ to be decremented by ten (step 141), and control returns to step 114.

If it is determined that detecting signal $E_{100}$ is input at step 131, that detecting signal $E_{10}$ is not input at step 134 or that control signal $CM10_{10}$ is not input at step 135, control proceeds to the operation shown in FIG. 5. As shown in FIG. 5, coin return control unit 50 determines whether the counted number of deposited coin number counter $CT_{50}$ is zero or not, based on counting signal $C_{50}$ of the deposited coin number counter (step 142).

If the counted number is determined to be zero at step 142, it is determined whether detecting signal $E_{50}$ of change running-out detecting means 14*a* for fifty unit coins is input (step 143). If detecting signal $E_{50}$ is determined not to be input at step 143, it is determined whether detecting signal $E_{10}$ of change running-out detecting means 13*a* for ten unit coins is input (step 144).

If detecting signal $E_{10}$ is determined to be input at step 144, it is determined the counted number of deposited coin number counter $CT_{10}$ for ten unit coins is not less than threshold number $TH10_5$ (=5) and therefore that control signal $CM10_5$ of comparator 21*c* of comparison means 20 is input (step 145).

Figure 6:
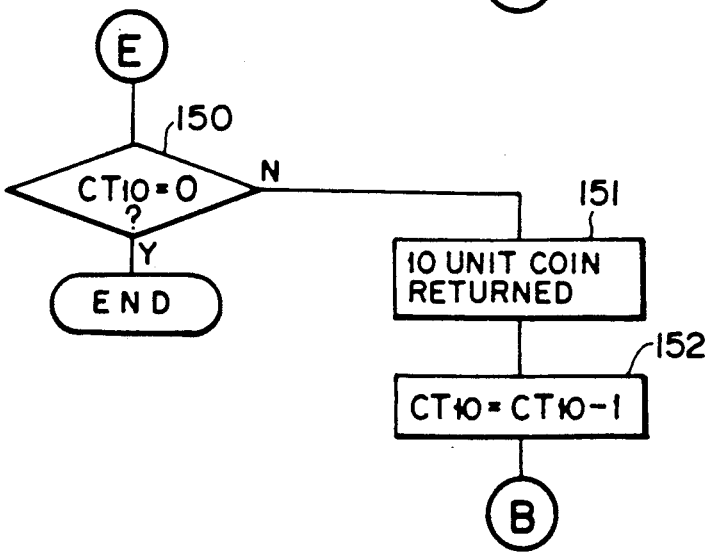

If it is determined that detecting signal $E_{50}$ is input at step 143, that detecting signal $E_{10}$ is not input at step 144, or that control signal $CM10_5$ is not input at step 145, control proceeds to the operation shown in FIG. 6 beginning at step 150.

On the other hand, if it is determined that the counted number of deposited coin number counter $CT_{50}$ is not zero at step 142 or that control signal $CM10_5$ is input at step 145, coin return control unit 50 outputs paying-out signal $P_{50}$ to coin paying-out mechanism 16. According to this $P_{50}$ signal, a fifty unit coin is returned from fifty unit coin retaining tube 14 to return opening 11 (step 146).

Thereafter, it is determined whether the counted number of deposited coin number counter $CT_{50}$ for fifty unit coins is zero (step 147). If the counted number is determined not to be zero, subtraction signal $CD_{50}$ is output to deposited coin number counter $CT_{50}$ to subtract one from the counted number. This causes deposited coin number counter $CT_{50}$ to be decremented by one (step 148), and control returns to step 114 shown in FIG. 3.

If the counted number of deposited coin number counter $CT_{50}$ is determined to be zero at step 147, subtraction signal $CD_{10}$ is output to deposited coin number counter $CT_{10}$ to subtract five from the counted number. This causes deposited coin number counter $CT_{10}$ to be decremented by five (step 149), and control returns to step 114.

As shown in FIG. 6 coin return control unit 50 determines whether the counted number of deposited coin number counter $CT_{10}$ is zero or not, based on counting signal $C_{10}$ of the deposited coin number counter $CT_{10}$ (step 150). If the counted number of deposited coin number counter $CT_{10}$ is determined not to be zero at step 150, coin return control unit 50 outputs paying-out signal $P_{10}$ to coin paying-out mechanism 16 and subtraction signal $CD_{10}$ to deposited coin number counter $CT_{10}$. A ten unit coin is returned from ten unit coin retaining tube 13 to return opening 11 according to paying-out signal $P_{10}$ (step 151) and the counted number of deposited coin number counter $CT_{10}$ is decremented by one (step 152), and control returns to step 114 shown in FIG. 3.

On the other hand, if it is determined at step 150 that the counted number is zero, the operation of the above coin return control is finished.

In the above first embodiment according to the present invention, when a smaller denomination coin is in its change running-out state and coins are deposited in this state, if the number of the deposited smaller denomination coins is not less than the number corresponding to the denomination of a larger denomination coin and the change running-out detecting means for the larger denomination coins does not detect the change running-out state, the larger denomination coin is returned instead of the smaller denomination coins. Therefore, the change running-out state of the smaller denomination coins can be certainly canceled, thereby increasing the chance of a vending machine sale to a great extent.

Moreover, the above substitution of the larger denomination coin for the smaller denomination coins is carried out only when the smaller denomination coin is in its change running-out state, therefore, use of the vending machine as a coin exchange machine can be adequately prevented.

Although four types of coins of five hundred unit coins, one hundred unit coins, fifty unit coins and ten unit coins can be used in the above embodiment, these numbers are by way of example only and the type of coins is not restricted to these types.

FIGS. 7–12 illustrate a second embodiment of the present invention. The system according to this embodiment further comprises stored coin number counters $MS_{500}$, $MS_{10}$, $MS_{50}$ and $MS_{100}$ and a second comparison means 30. Coin inlet 1, coin guide path 2, coin testing means 3, distributing gate means 4, coin paths 5, 6, 7, 8 and 9, slug chute 10, return opening 11, change retaining tubes 12, 13, 14 and 15, change running-out detecting means 12*a*, 13*a*, 14*a* and 15*a*, coin paying-out mechanism 16, deposited coin counters $CT_{500}$, $CT_{10}$, $CT_{50}$ and $CT_{100}$ and a first comparison means 20 including comparators 21*a*, 21*b*, 21*c*, 22*a*, 22*b* and 23 are substantially the same as corresponding parts in the first embodiment.

Counting signals $C_{500}$, $C_{10}$, $C_{50}$ and $C_{100}$ from deposited coin number counters $CT_{500}$, $CT_{10}$, $CT_{50}$ and $CT_{100}$, threshold numbers $TH10_{50}$, $TH10_{10}$, $TH10_5$, $TH50_{10}$, $TH50_2$ and $TH100_5$, first control signals $CM10_{50}$, $CM10_{10}$, $CM10_5$, $CM50_{10}$, $CM50_2$ and $CM100_5$, and the signals $CD_{500}$, $CD_{10}$, $CD_{50}$ and $CD_{100}$ are substantially the same as corresponding signals and numbers in the first embodiment.

Stored coin number counter $MS_{500}$ for five hundred unit coins is set to a predetermined initial value, e.g. "2" by input of detecting signal $E_{500}$ of change running-out detecting means 12*a*, adds the number of five hundred unit coins deposited into change retaining tube 12 to the prior number of the coins retained in the tube by input of determining signals $DS_{500}$ of coin testing means 3, subtracts the number of the coins paid out from the tube by input of paying-out signal $P_{500}$ (described later), and adds a number to the prior number by input of addition signal $MU_{500}$ (described later).

Stored coin number counter $MS_{10}$ for ten unit coins is set to a predetermined initial value e.g. "12" by input of detecting signal $E_{10}$ of change running-out detecting means 13*a*, adds the number of ten unit coins deposited into change retaining tube 13 to the prior number of the coins retained in the tube by input of determining signals $DS_{10}$ of coin testing means 3, subtracts the number of the coins paid out from the tube by input of paying-out signal $P_{10}$ (described later), and adds a number to the prior number by input of addition signal $MU_{10}$ (described later).

Stored coin number counter $MS_{50}$ for fifty unit coins is set to a predetermined initial value e.g. "10" by input of detecting signal $E_{50}$ of change running-out detecting means 14*a*, adds the number of fifty unit coins deposited into change retaining tube 14 to the prior number of the coins retained in the tube by input of determining signals $DS_{50}$ of coin testing means 3, subtracts the number of the coins paid out from the tube by input of paying-out signal $P_{50}$ (described later), and adds a number to the prior number by input of a addition signal $MU_{50}$ (described later).

Stored coin number counter $MS_{100}$ for one hundred unit coins is set to a predetermined initial value e.g. "10" by input of detecting signal $E_{100}$ of change running-out detecting means 15*a*, adds the number of one hundred unit coins deposited into change retaining tube 15 to the prior number of the coins retained in the tube by input of determining signals $DS_{100}$ of coin testing means 3, subtracts the number of the coins paid out from the tube by input of paying-out signal $P_{100}$ (described later), and adds a number to the prior number by input of a addition signal $MU_{100}$ (described later).

Second comparison means 30 compares counting signals $M_{500}$, $M_{10}$, $M_{50}$ and $M_{100}$ which represent the counted numbers of respective stored coin number counters $MS_{500}$, $MS_{10}$, $MS_{50}$ and $MS_{100}$ with the corresponding predetermined initial values (preset values; e.g. "2", "12", "10" and "10") for the respective stored coin number counters, and outputs second control signals if the respective counted numbers are greater than the corresponding predetermined initial values.

More specifically, comparator 31 compares stored number counting signal $M_{500}$ representing the counted number of stored coin number counter $MS_{500}$ for five hundred unit coins with a predetermined initial value $PS500_2$ (=2), and outputs a second control signal $CP_{500}$ if the counted number of the stored number counting signal is greater than the predetermined initial value of 2. A comparator 32 compares stored number counting signal $M_{10}$ representing the counted number of stored coin number counter $MS_{10}$ for ten unit coins with a predetermined initial value $PS10_{12}$ (=12), and outputs a second control signal $CP_{10}$ if the counted number of the stored number counting signal is greater than the predetermined initial value of 12. A comparator 33 compares stored number counting signal $M_{50}$ representing the counted number of stored coin number counter $MS_{50}$ for fifty unit coins with a predetermined initial value $PS50_{10}$ (=10), and outputs a second control signal $CP_{50}$ if the counted number of the stored number counting signal is greater than the predetermined initial value of 10. A comparator 34 compares stored number counting signal $M_{100}$ representing the counted number of stored coin number counter $MS_{100}$ for one hundred unit coins with a predetermined initial value $PS100_{10}$ (=10), and outputs a second control signal $CP_{100}$ if the counted number of the stored number counting signal is greater than the predetermined initial value of 10.

A coin return control unit 60 sets paying-out signals $P_{500}$, $P_{10}$, $P_{50}$ and $P_{100}$ representing the numbers of the respective types of coins to be paid out (to be returned) in accordance with input of detecting signals $E_{500}$, $E_{10}$, $E_{50}$ and $E_{100}$ by change running-out detecting means 12*a*, 13*a*, 14*a* and 15*a*, counting signals $C_{500}$, $C_{10}$, $C_{50}$ and $C_{100}$ by deposited coin number counters $CT_{500}$, $CT_{10}$, $CT_{50}$ and $CT_{100}$ and stored number counting signals $M_{500}$, $M_{10}$, $M_{50}$ and $M_{100}$ by stored coin number counters $MS_{500}$, $MS_{10}$, $MS_{50}$ and $MS_{100}$, respectively, when return signal RS from a return signal generating means 100 is input to the unit, and outputs the paying-out signals to coin paying-out mechanism 16. At the same time, coin return control unit 60 outputs paying-out signal $P_{500}$ and addition signal $MU_{500}$ to stored coin number counter $MS_{500}$; paying-out signal $P_{10}$ and addition signal $MU_{10}$ to stored coin number counter $MS_{10}$; paying-out signal $P_{50}$ and addition signal $MU_{50}$ to stored coin number counter $MS_{50}$; and paying-out signal $P_{100}$ and addition signal $MU_{100}$ to stored coin number counter $MS_{100}$, respectively, and outputs subtraction signal $CD_{500}$ to deposited coin number counter $CT_{500}$, subtraction signal $CD_{10}$ to deposited coin number counter $CT_{10}$, subtraction signal $CD_{50}$ to deposited coin number counter $CT_{50}$ and subtraction signal $CD_{100}$ to deposited coin number counter $CT_{100}$, respectively.

Figure 7:
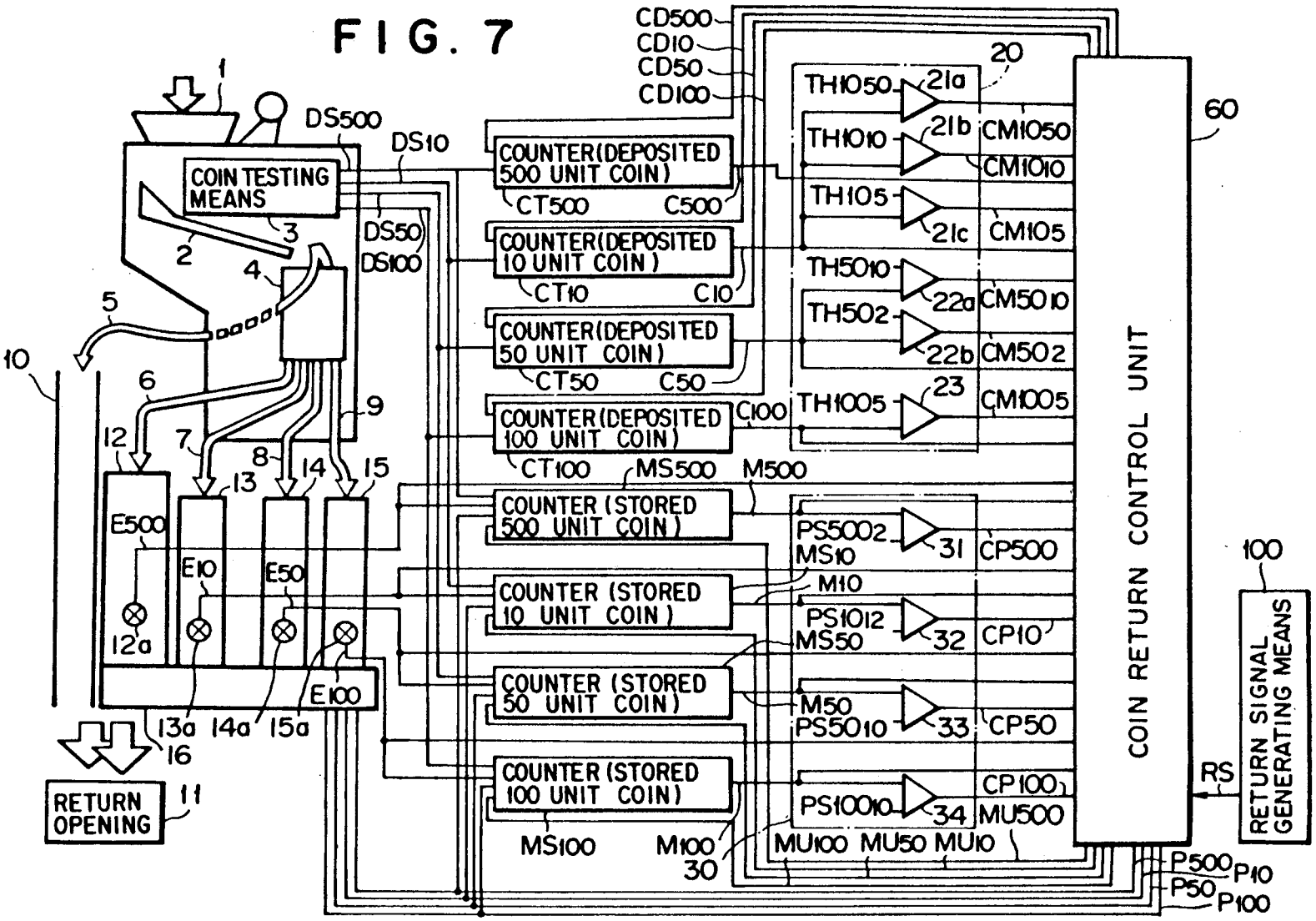
FIG. 7 is a schematic view of a coin return control system according to a second embodiment of the present invention.

Further, coin return control unit 60 sets paying-out signals $P_{500}$, $P_{10}$, $P_{50}$ and $P_{100}$ to pay out (return) relatively larger denomination coins instead of the relatively smaller denomination coins if, when return signal RS is input, at least one of detecting signals $E_{10}$, $E_{50}$ and $E_{100}$ of change running-out detecting means 13*a*, 14*a* and 15*a* is input, at least one of first control signals $CM10_{50}$, $CM10_{10}$, $CM10_5$, $CM50_{10}$, $CM50_2$ and $CM100_5$ from comparators 21*a*, 21*b*, 21*c*, 22*a*, 22*b* and 23 is input and second control signal CP500, CP10, CP50 or CP100 of comparator 31, 32, 33 or 34 is input, and outputs the paying-out signals to coin paying-out mechanism 16 and stored coin number counters $MS_{500}$, $MS_{10}$, $MS_{50}$ and $MS_{100}$, The operation of the system shown in FIG. 7 will be explained with reference to flowcharts shown in FIGS. 8–12 Here, deposited coins are all assumed to be acceptable coins.

Figure 2:
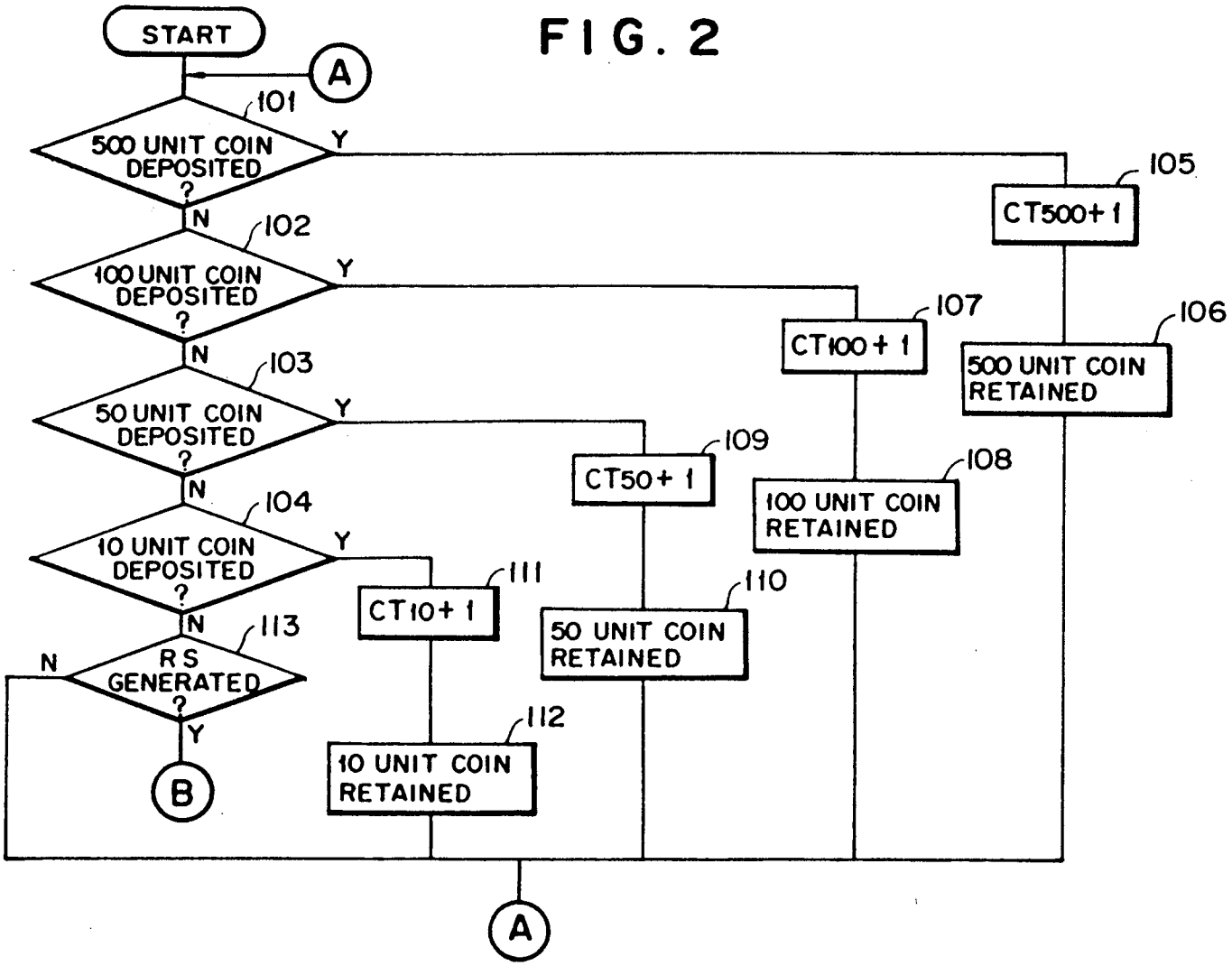
FIGS. 2 to 6 are flowcharts of the control system of FIG. 1.
Figure 3:
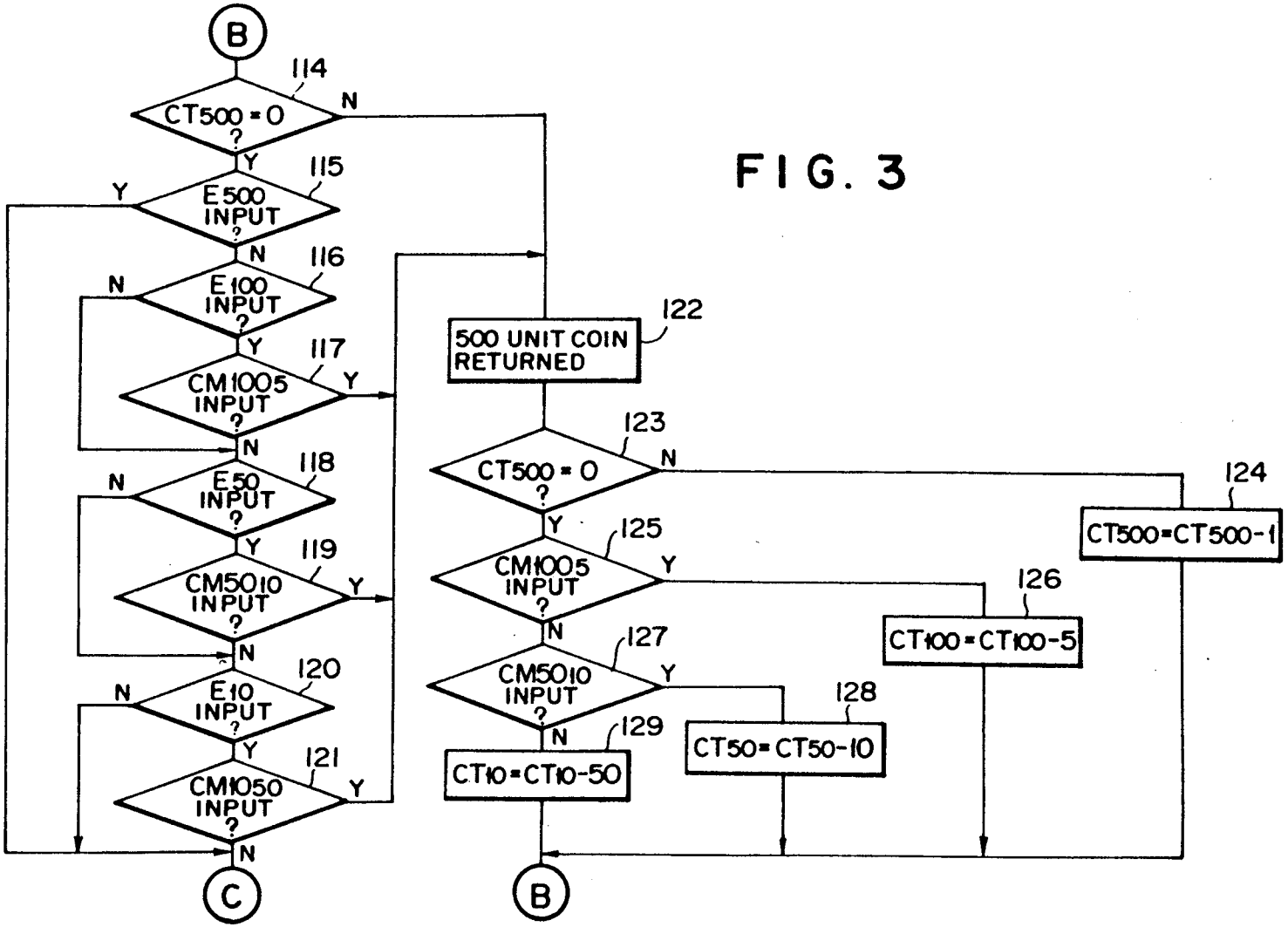

The determination of the type of deposited coins by coin testing means 3 is substantially the same as in the flow shown in FIG. 2 (steps 201–204). Determining signal $DS_{500}$ for a five hundred unit coin is input to deposited coin number counter $CT_{500}$ and stored coin number counter $MS_{500}$, and the counters are each incremented by one (steps 205 and 206). The deposited five hundred unit coin is sent to change retaining tube 12 for five hundred unit coins (step 207). Determining signal $DS_{100}$ for a one hundred unit coin is input to deposited coin number counter $CT_{100}$ and stored coin number counter $MS_{100}$, and the counters are each incremented by one (steps 208 and 209). The deposited one hundred unit coin is sent to change retaining tube 15 for one hundred unit coins (step 210). Determining signal $DS_{50}$ for a fifty unit coin is input to deposited coin number counter $CT_{50}$ and stored coin number counter $MS_{50}$, and the counters are each incremented by one (steps 211 and 212). The deposited fifty unit coin is sent to change retaining tube 14 for fifty unit coins (step 213). Determining signal $DS_{10}$ for a ten unit coin is input to deposited coin number counter $CT_{10}$ and stored coin number counter $MS_{10}$, and the counters are each incremented by one (steps 214 and 215). The deposited ten unit coin is sent to change retaining tube 13 for ten unit coins (step 216). Control returns from step 207, 210, 213 or 216 to step 201.

If it is determined that no type of coin is deposited at steps 201–204, coin return control unit 60 determines whether return signal RS is generated by operation of return signal generating means 100 (step 217). If return signal RS is generated, control proceeds to the coin return control shown in FIGS. 9–12.

Coin return control unit 60 determines by counting signal $C_{500}$ of deposited coin number counter $CT_{500}$ for five hundred unit coins whether the counted number of the deposited coin number counter is zero (step 218). If the counted number is determined to be zero at step 218, it is determined whether the counted number of stored coin number counter $MS_{500}$ for five hundred unit coins is greater than the predetermined initial value "2" and therefore that second control signal CP500 of comparator 31 of second comparison means 30 is input (step 219). If it is determined at step 219 that second control signal CP500 is input, it is determined whether detecting signal $E_{100}$ of change running-out detecting means 15*a* for one hundred unit coins is input (step 220).

If it is determined that detecting signal $E_{100}$ is input at step 220, it is determined whether the counted number of deposited coin number counter $CT_{100}$ is not less than threshold number TH $100_5$ (=5) and therefore that first control signal $CM100_5$ of comparator 23 of first comparison means 20 is input or not (step 221).

If it is determined that detecting signal $E_{100}$ is not input at step 220 or that first control signal $CM100_5$ is not input at step 221, it is determined whether detecting signal $E_{50}$ of change running-out detecting means 14*a* for fifty unit coins is input (step 222). If detecting signal $E_{50}$ is input, it is determined whether the counted number of deposited coin number counter $CT_{50}$ is not less than threshold number $TH50_{10}$ (=10) and therefore that first control signal $CM50_{10}$ of comparator 22*a* is input (step 223).

If it is determined that detecting signal $E_{50}$ is not input at step 222 or that first control signal $CM50_{10}$ is not input at step 223, it is determined whether detecting signal $E_{10}$ of change running-out detecting means 13*a* for ten unit coins is input (step 224). If detecting signal $E_{10}$ is input, it is determined whether the counted number of deposited coin number counter $CT_{10}$ is not less than threshold number $TH10_{50}$ (=50) and therefore that first control signal $CM10_{50}$ of comparator 21*a* is input (step 225).

On the other hand, if it is determined that the counted number of deposited coin number counter $CT_{500}$ is not zero at step 218, that first control signal $CM100_5$ is input at step 221, that first control signal $CM50_{10}$is input at step 223, or that first control signal $CM10_{50}$ is input at step 225, coin return control unit 60 outputs paying-out signal $P_{500}$ to coin paying-out mechanism 16 and stored coin number counter $MS_{500}$. According to this $P_{500}$ signal, a five hundred unit coin is returned from change retaining tube 12 for five hundred unit coins to return opening 11 (step 226), and the counted number of stored coin number counter $MS_{500}$ is decremented by one (step 227).

Thereafter, coin return control unit 60 determines whether detecting signal $E_{500}$ of change running-out detecting means 12*a* is input (step 228). If detecting signal $E_{500}$ is determined to be input at step 228, it is determined whether second control signal CP500 of comparator 31 of second comparison means 30 is input (step 229). If the second control signal CP500 is input, the counted number of stored coin number counter $MS_{500}$ is determined to be "2" (step 230).

After the determination at step 230, or if it is determined that detecting signal $E_{500}$ is not input at step 228 or that second control signal CP500 is not input at step 229, it is determined whether the counted number of deposited coin number counter $CT_{500}$ for five hundred unit coins is zero (step 231). If the counted number is not zero, subtraction signal $CD_{500}$ is output to deposited coin number counter $CT_{500}$ so as to subtract one from the counted number. This causes deposited coin number counter $CT_{500}$ to be decremented by one (step 232), and control returns to step 218.

If the counted number of deposited coin number counter $CT_{500}$ is determined to be zero at step 231, it is determined whether first control signal $CM100_5$ is input (step 233). If first control signal $CM100_5$ is input, subtraction signal $CD_{100}$ is output to deposited coin number counter $CT_{100}$ to subtract five from its counted number, and addition signal $MU_{100}$ is output to stored coin number counter $MS_{100}$ to add five to its counted number. This causes deposited coin number counter $CT_{100}$ to be decremented by five (step 234) and stored coin number counter $MS_{100}$ to be incremented by five (step 235), and control returns to step 218.

If first control signal $CM100_5$ is determined not to be input at step 233, it is determined whether first control signal $CM50_{10}$ is input (step 236). If first control signal $C50_{10}$ is input, subtraction signal $CD_{50}$ is output to deposited coin number counter $CT_{50}$ to subtract ten from its counted number, and addition signal $MU_{50}$ is output to stored coin number counter $MS_{50}$ to add ten to its counted number. This causes deposited coin number counter $CT_{50}$ to be decremented by ten (step 237) and stored coin number counter $MS_{50}$ to be incremented by ten (step 238), and control returns to step 218.

If first control signal $CM50_{10}$ is determined not to be input at step 236, subtraction signal $CD_{10}$ is output to deposited coin number counter $CT_{10}$ to subtract fifty from its counted number, and addition signal $MU_{10}$ is output to stored coin number counter $MS_{10}$ to add fifty to its counted number. This causes deposited coin number counter $CT_{10}$ to be decremented by fifty (step 239) and stored coin number counter $MS_{10}$ to be incremented by fifty (step 240), and control returns to step 218.

Figure 10:
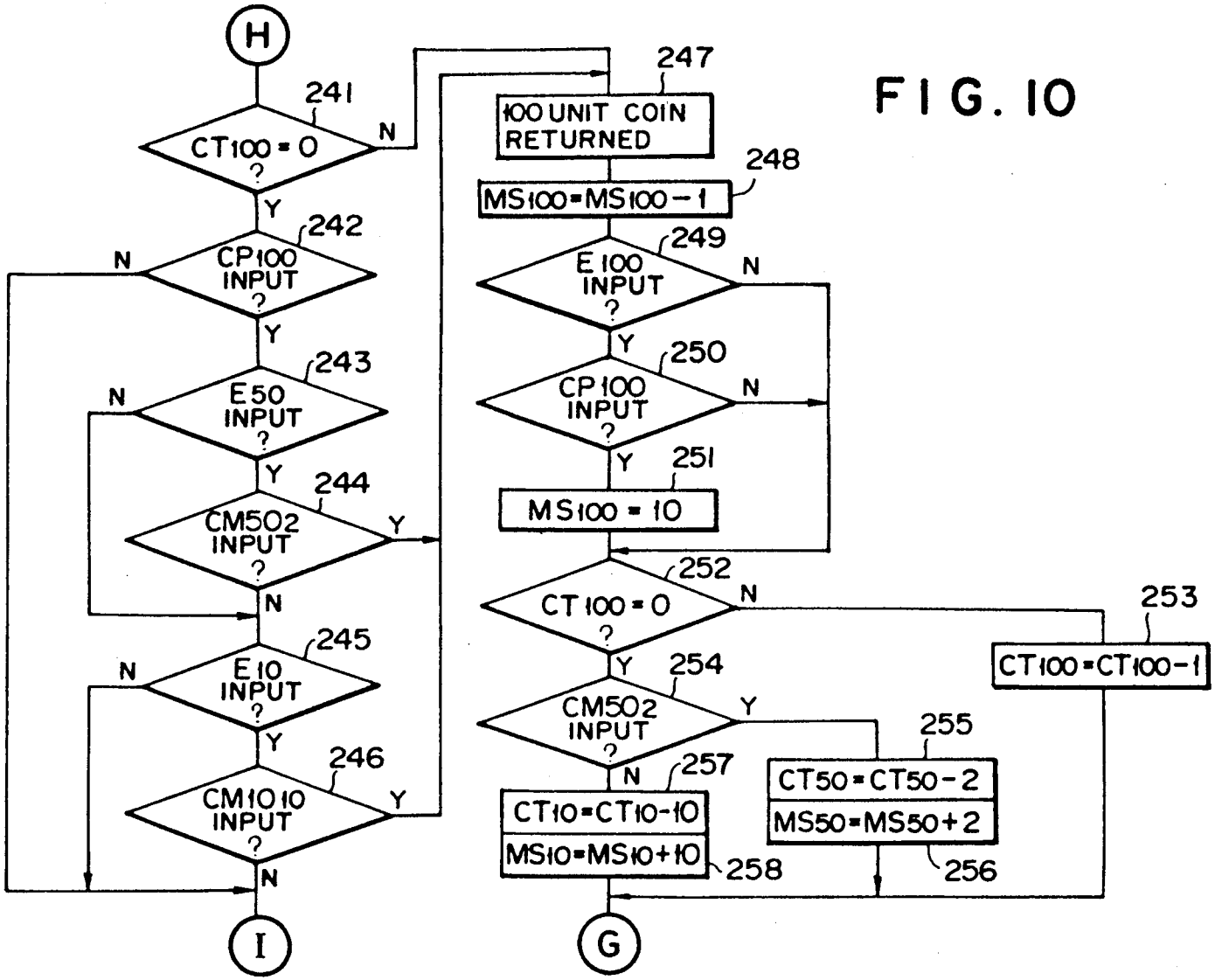

If it is determined that second control signal CP500 is not input at step 219, that detecting signal $E_{10}$ is not input at step 224, or that first control signal $CM10_{50}$ is not input at step 225, control proceeds to the operation shown in FIG. 10.

As shown in FIG. 10 coin return control unit 60 determines whether the counted number of deposited coin number counter $CT_{100}$ is zero or not, by counting signal $C_{100}$ of the deposited coin number counter (step 241). If the counted number is determined to be zero at step 241, it is determined whether the counted number of stored coin number counter $MS_{100}$ for one hundred unit coins is greater than its predetermined initial value and therefore that second control signal CP100 of comparator 34 of second comparison means 30 is input (step 242). If second control signal CP100 is determined to be input at step 242, it is determined whether detecting signal $E_{50}$ of change running-out detecting means 14*a* for fifty unit coins is input (step 243).

If detecting signal $E_{50}$ is determined to be input at step 243, it is determined whether the counted number of deposited coin number counter $CT_{50}$ for fifty unit coins is not less than threshold value $TH50_2$ (=2) and therefore that first control signal $CM50_2$ of comparator 22*b* of first comparison means 20 is input (step 244).

If it is determined that detecting signal $E_{50}$ is not input at step 243 or that first control signal $CM50_2$ is not input at step 244, it is determined whether detecting signal $E_{10}$ of change running-out detecting means 13*a* for ten unit coins is input (step 245). If detecting signal $E_{10}$ is input, it is determined whether the counted number of deposited coin number counter $CT_{10}$ is not less than threshold number $TH10_{10}$ (=10) and therefore that first control signal $CM10_{10}$ of comparator 21*b* is input (step 246).

Figure 11:
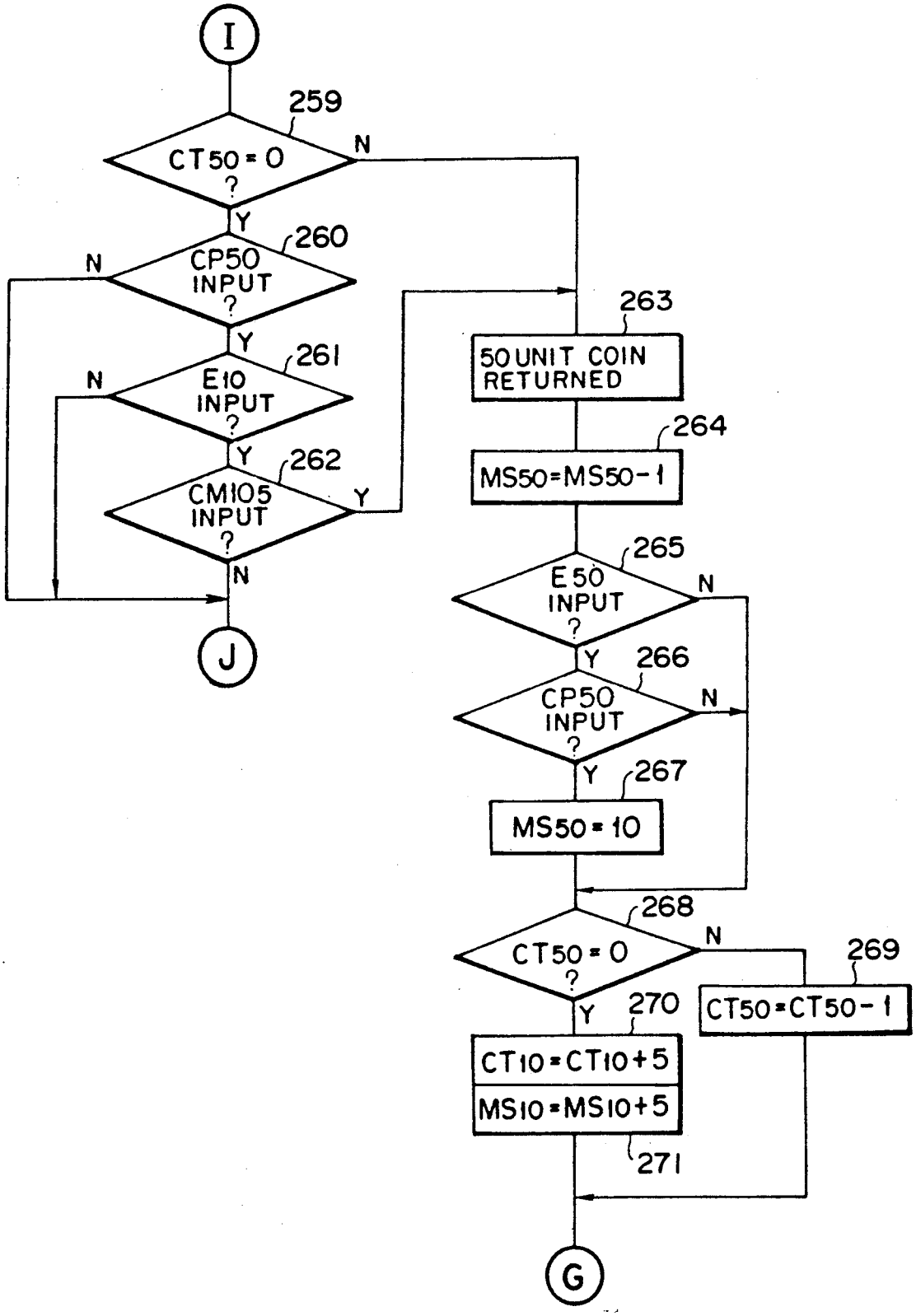

If it is determined that first control signal $CM10_{10}$ is not input at step 246, that second control signal CP100 is not input at step 242 or that detecting signal $E_{10}$ is not input at step 245, control proceeds to the operation shown in FIG. 11.

On the other hand, if it is determined that the counted number of deposited coin number counter $CT_{100}$ is not zero at step 241, that first control signal $CM50_2$ is input at step 244, or that first control signal $CM10_{10}$ is input at step 246, coin return control unit 60 outputs paying-out signal $P_{100}$ to coin paying-out mechanism 16 and stored coin number counter $MS_{100}$. According to this $P_{100}$ signal, a one hundred unit coin is returned from change retaining tube 15 for one hundred unit coins to return opening 11 (step 247), and the counted number of stored coin number counter $MS_{100}$ is decremented by one (step 248).

Thereafter, coin return control unit 60 determines whether detecting signal $E_{100}$ of change running-out detecting means 15*a* is input (step 249). If detecting signal $E_{100}$ is determined to be input at step 249, it is determined whether second control signal CP100 of comparator 34 of second comparison means 30 is input (step 250). If the second control signal CP100 is input, the counted number of stored coin number counter $MS_{100}$ is determined to be "10" (step 251).

After the determination at step 251, or if it is determined that detecting signal $E_{100}$ is not input at step 249 or that second control signal CP100 is not input at step 250, it is determined whether the counted number of deposited coin number counter $CT_{100}$ for one hundred unit coins is zero (step 252). If the counted number is not zero, subtraction signal $CD_{100}$ is output to deposited coin number counter $CT_{100}$ to subtract one from the counted number. This causes deposited coin number counter $CT_{100}$ to be decremented by one (step 253), and control returns to step 218.

If the counted number of deposited coin number counter $CT_{100}$ is determined to be zero at step 252, it is determined whether first control signal $CM50_2$ is input (step 254). If first control signal $CM50_2$ is input, subtraction signal $CD_{50}$ is output to deposited coin number counter $CT_{50}$ to subtract two from its counted number, and addition signal $MU_{50}$ is output to stored coin number counter $MS_{50}$ to add two to its counted number. This causes deposited coin number counter $CT_{50}$ to be decremented by two (step 255) and stored coin number counter $MS_{50}$ to be incremented by two (step 256), and control returns to step 218.

If first control signal $CM50_2$ is determined not to be input at step 254, subtraction signal $CD_{10}$ is output to deposited coin number counter $CT_{10}$ to subtract ten from its counted number, and addition signal $MU_{10}$ is output to stored coin number counter $MS_{10}$ to add ten to its counted number. This causes deposited coin number counter $CT_{10}$ to be decremented by ten (step 257) and stored coin number counter $MS_{10}$ to be incremented by ten (step 258), and control returns to step 218.

If it is determined that second control signal $CP_{100}$ is not input at step 242, that detecting signal $E_{10}$ is not input at step 245, or that first control signal $CM10_{10}$ is not input at step 246, flow proceeds to the operation shown in FIG. 11.

As shown in FIG. 11 coin return control unit 60 determines whether the counted number of deposited coin number counter $CT_{50}$ is zero or not, based on counting signal $C_{50}$ of the deposited coin number counter (step 259). If the counted number is determined to be zero at step 259, it is determined whether the counted number of stored coin number counter $MS_{50}$ for fifty unit coins is greater than its predetermined initial value and therefore that second control signal CP50 of comparator 33 of second comparison means 30 is input (step 260). If second control signal CP50 is determined to be input at step 260, it is determined whether detecting signal $E_{10}$ of change running-out detecting means 13*a* for ten unit coins is input (step 261).

If detecting signal $E_{10}$ is determined to be input at step 261, it is determined whether the counted number of deposited coin number counter $CT_{10}$ for ten unit coins is not less than threshold value $TH10_5$ (=5) and therefore that first control signal $CM10_5$ of comparator 21*c* of first comparison means 20 is input (step 262).

On the other hand, if it is determined that the counted number of deposited coin number counter $CT_{50}$ is not zero at step 259 or that first control signal $CM10_5$ is input at step 262, coin return control unit 60 outputs paying-out signal $P_{50}$ to coin paying-out mechanism 16 and stored coin number counter $MS_{50}$. According to this $P_{50}$ signal, a fifty unit coin is returned from change retaining tube 14 for fifty unit coins to return opening 11 (step 263), and the counted number of stored coin number counter $MS_{50}$ is decremented by one (step 264).

Thereafter, coin return control unit 60 determines whether detecting signal $E_{50}$ of change running-out detecting means 14*a* is input (step 265). If detecting signal $E_{50}$ is determined to be input at step 265, it is determined whether second control signal CP50 of comparator 33 of second comparison means 30 is input (step 266). If the second control signal CP50 is input, the counted number of stored coin number counter $MS_{50}$ is determined to be "10" (step 267).

After the determination at step 267, or if it is determined that detecting signal $E_{50}$ is not input at step 265 or that second control signal CP50 is not input at step 266, it is determined whether the counted number of deposited coin number counter $CT_{50}$ for fifty unit coins is zero (step 268). If the counted number is not zero, subtraction signal $CD_{50}$ is output to deposited coin number counter $CT_{50}$ to subtract one from the counted number. This causes deposited coin number counter $CT_{50}$ to be decremented by one (step 269), and control returns to step 218.

If the counted number of deposited coin number counter $CT_{50}$ is determined to be zero at step 268, subtraction signal $CD_{10}$ is output to deposited coin number counter $CT_{10}$ to subtract five from its counted number, and addition signal $MU_{10}$ is output to stored coin number counter $MS_{10}$ to add five to its counted number. This causes deposited coin number counter $CT_{10}$ to be decremented by five (step 270) and stored coin number counter $MS_{10}$ to be incremented by five (step 271), and control returns to step 218.

Figure 12:
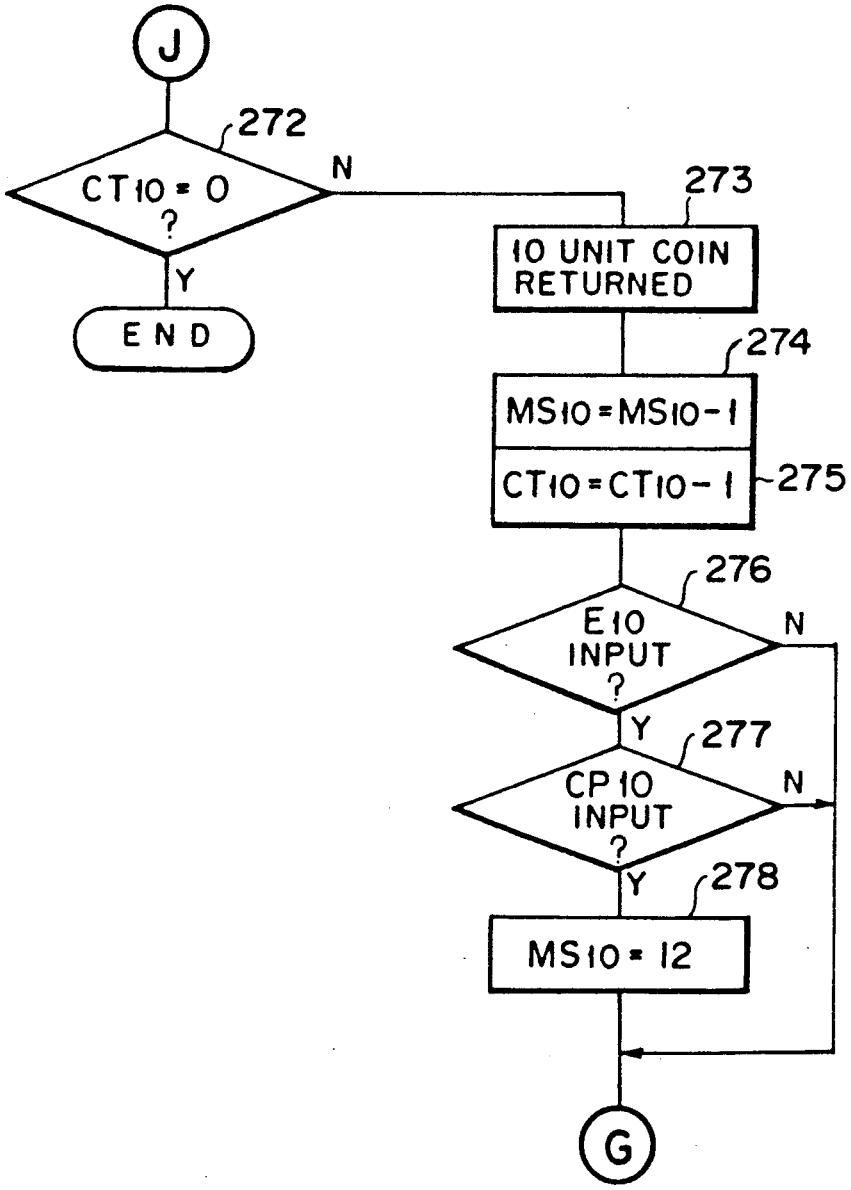

If it is determined that second control signal CP50 is not input at step 260, that detecting signal $E_{10}$ is not input at step 261, or that first control signal $CM10_5$ is not input at step 262, flow proceeds to the operation shown in FIG. 12.

As shown in FIG. 12 coin return control unit 60 determined whether the counted number of deposited coin number counter $CT_{10}$ is zero or not, based on counting signal $C_{10}$ of the deposited coin number counter $CT_{10}$ (step 272). If the counted number is determined not to be zero at step 272, coin return control unit 60 outputs paying-out signal $P_{10}$ to coin paying-out mechanism 16 and stored coin number counter $MS_{10}$ and outputs subtraction signal $CD_{10}$ to deposited coin number counter $CT_{10}$. According to this $P_{10}$ signal, a ten unit coin is returned from change retaining tube 13 for ten unit coins to return opening 11 (step 272), and the counted number of stored coin number counter $MS_{10}$ is decremented by one (step 264) and deposited coin number counter $CT_{10}$ is also decremented by one (step 275).

Thereafter, coin return control unit 60 determines whether detecting signal $E_{10}$ of change running-out detecting means 13*a* is input (step 276). If detecting signal $E_{10}$ is determined to be input at step 276, it is determined whether second control signal CP10 of comparator 32 of second comparison means 30 is input (step 277). If the second control signal CP10 is input, the counted number of stored coin number counter $MS_{10}$ is determined to be "12" (step 278).

Figure 9:
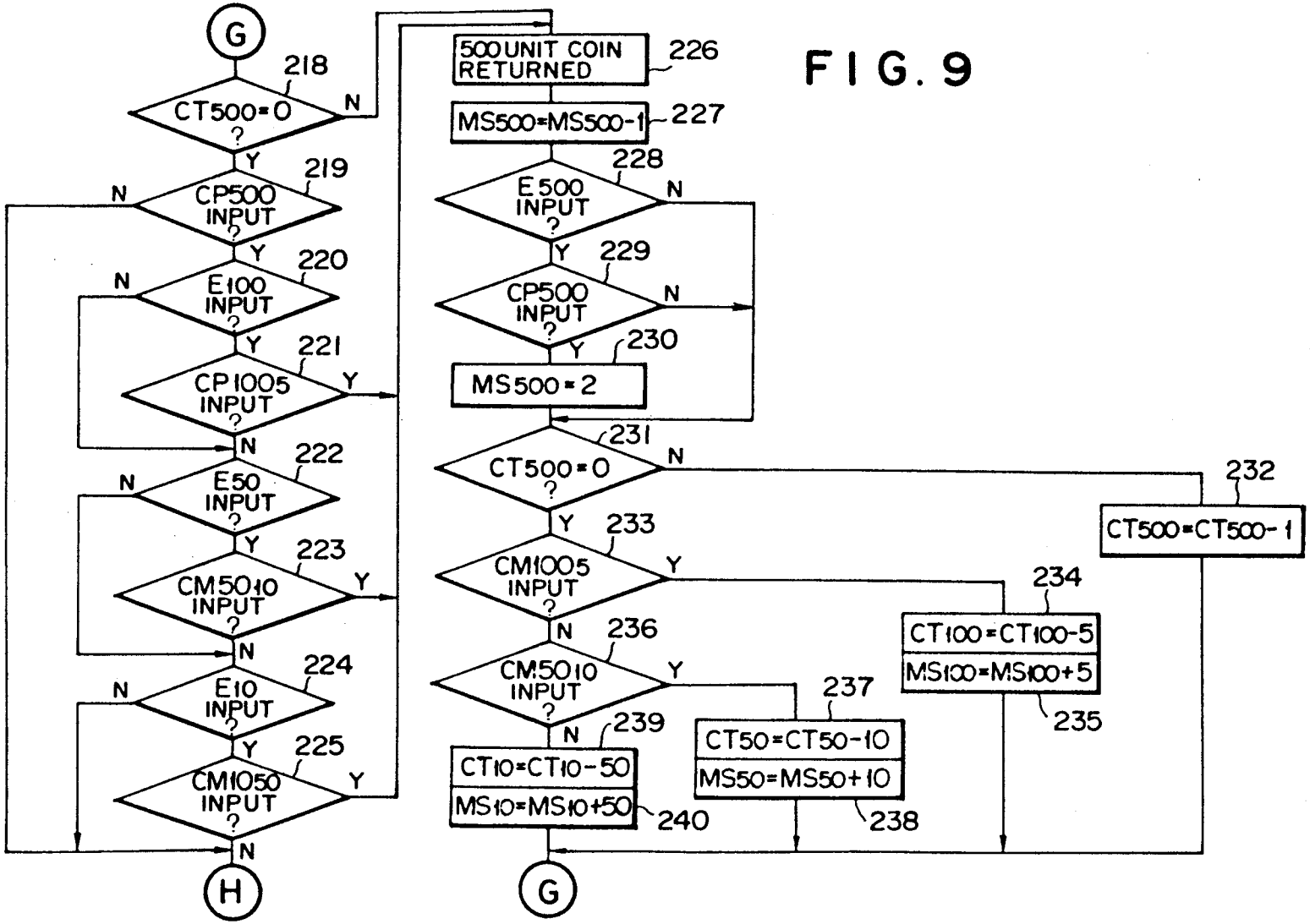

After the determination at step 278, or if it is determined that detecting signal $E_{10}$ is not input at step 276, control returns to step 218 shown in FIG. 9.

On the other hand, if the counted number is determined to be zero at step 272, the operation of the coin return control is finished.

In the second embodiment, the relatively larger denomination coin is adequately returned instead of the smaller denomination coins, only when the smaller denomination coin is in its change running-out state. Therefore, the chance for a vending machine sale can be increased, and the use of the vending machine as a coin exchange machine can be adequately prevented.

Figure 13:
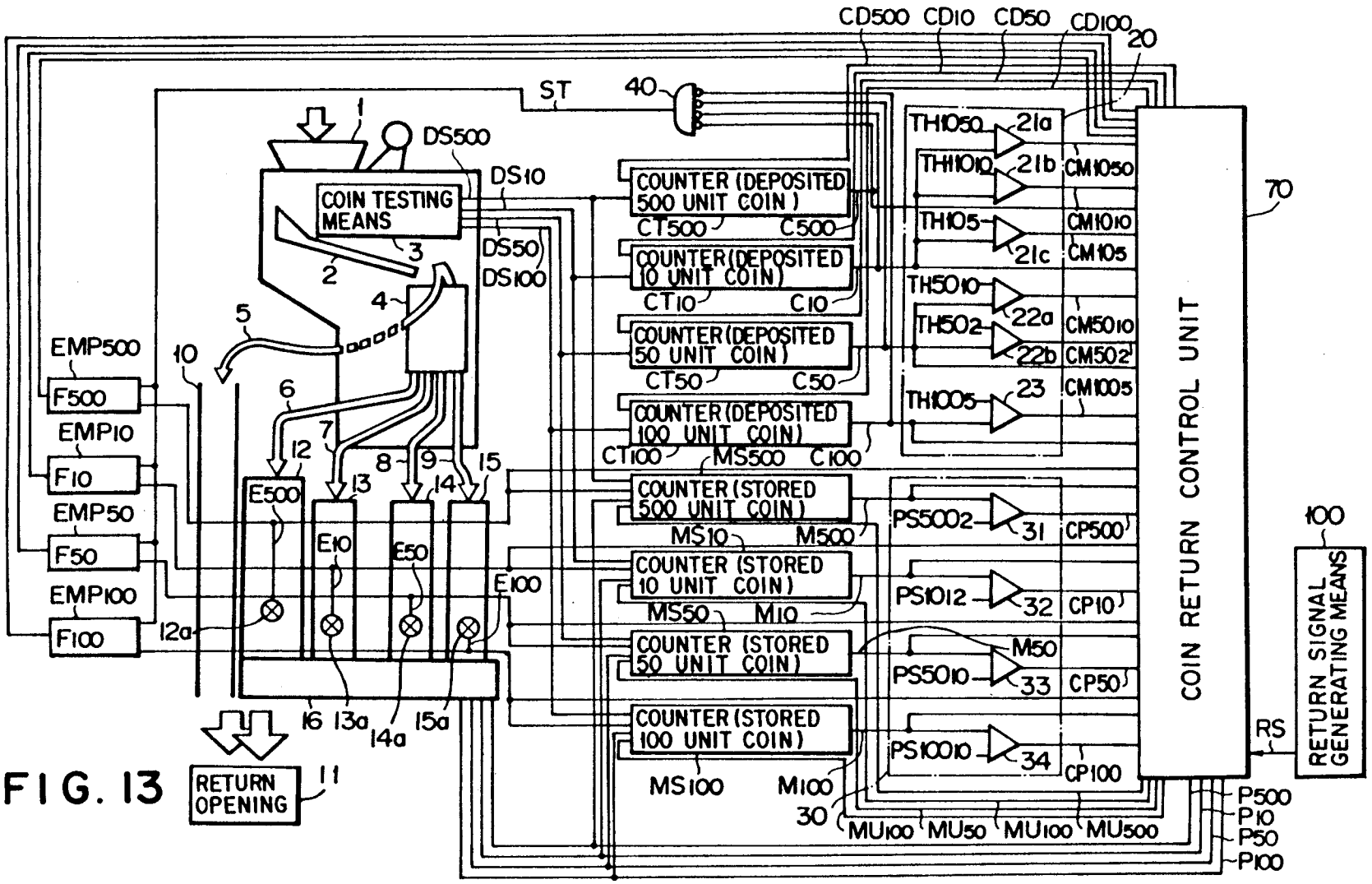
FIG. 13 is a schematic view of a coin return control system according to a third embodiment of the present invention.

FIGS. 13–19 illustrate a third embodiment of the present invention. The system according to this embodiment further comprises change running-out memory means $EMP_{500}$, $EMP_{10}$, $EMP_{50}$ and $EMP_{100}$ and a memory signal generation means 40, as compared with the second embodiment. Other elements in FIG. 13 are basically the same as those in FIG. 7, other than control by a coin return control unit 70.

Counting signals $C_{500}$, $C_{10}$, $C_{50}$ and $C_{100}$ of deposited coin number counters $CT_{500}$, $CT_{10}$, $CT_{50}$ and $CT_{100}$ are input to memory signal generation means 40, and the memory signal generation means outputs a memory signal ST only when all the counted numbers of deposited coin number counters $CT_{500}$, $CT_{10}$, $CT_{50}$ and $CT_{100}$ are zero (initial value).

Detecting signal $E_{500}$ of change running-out detecting means 12*a* for five hundred unit coins is input to change running-out memory means $EMP_{500}$. Change running-out memory means $EMP_{500}$ sets its flag $F_{500}$ to "1" by input of detecting signal $E_{500}$ and memory signal ST, and sets the flag to "0" if the detecting signal is not input when the memory signal is input.

Detecting signal $E_{10}$ of change running-out detecting means 13*a* for ten unit coins is input to change running-out memory means $EMP_{10}$. Change running-out memory means $EMP_{10}$ sets its flag $F_{10}$ to "1" by input of detecting signal $E_{10}$ and memory signal ST, and sets the flag to "0" if the detecting signal is not input when the memory signal is input.

Detecting signal $E_{50}$ of change running-out detecting means 14a for fifty unit coins is input to change running-out memory means $EMP_{50}$. Change running-out memory means $EMP_{50}$ sets its flag $F_{50}$ to "1" by input of detecting signal $E_{50}$ and memory signal ST, and sets the flag to "0" if the detecting signal is not input when the memory signal is input.

Detecting signal $E_{100}$ of change running-out detecting means 15a for one hundred unit coins is input to change running-out memory means $EMP_{100}$. Change running-out memory means $EMP_{100}$ sets its flag $F_{100}$ to "1" by input of detecting signal $E_{100}$ and memory signal ST, and sets the flag to "0" if the detecting signal is not input when the memory signal is input.

Functions of first comparison means 20 and second comparison means 30 are substantially the same as those in the second embodiment.

A coin return control unit 70 sets paying-out signals $P_{500}$, $P_{10}$, $P_{50}$ and $P_{100}$ representing the numbers of the respective types of coins to be paid out (to be returned) in accordance with the input of detecting signals $E_{500}$, $E_{10}$, $E_{50}$ and $E_{100}$ by change running-out detecting means 12a, 13a, 14a and 15a, counting signals $C_{500}$, $C_{10}$, $C_{50}$ and $C_{100}$ by deposited coin number counters $CT_{500}$, $CT_{10}$, $CT_{50}$ and $CT_{100}$ and stored number counting signals $M_{500}$, $M_{10}$, $M_{50}$ and $M_{100}$ by stored coin number counters $MS_{500}$, $MS_{10}$, $MS_{50}$ and $MS_{100}$, respectively, when return signal RS from a return signal generating means 100 is input to the unit, and outputs the paying-out signals to coin paying-out mechanism 16. At the same time, coin return control unit 70 outputs paying-out signal $P_{500}$ and addition signal $MU_{500}$ to stored coin number counter $MS_{500}$; paying-out signal $P_{10}$ and addition signal $MU_{10}$ to stored coin number counter $MS_{10}$; paying-out signal $P_{50}$ and addition signal $MU_{50}$ to stored coin number counter $MS_{50}$; and paying-out signal $P_{100}$ and addition signal $MU_{100}$ to stored coin number counter $MS_{100}$, respectively, and outputs subtraction signal $CD_{500}$ to deposited coin number counter $CT_{500}$, subtraction signal $CD_{10}$ to deposited coin number counter $CT_{10}$, subtraction signal $CD_{50}$ to deposited coin number counter $CT_{50}$ and subtraction signal $CD_{100}$ to deposited coin number counter $CT_{100}$, respectively.

Further, coin return control unit 70 sets paying-out signals $P_{500}$, $P_{10}$, $P_{50}$ and $P_{100}$ to pay out (return) the relatively larger denomination coins instead of the relatively smaller denomination coins if, when return signal RS is input, at least one of flags $F_{10}$, $F_{50}$ and $F_{100}$ of change running-out memory means $EMP_{10}$, $EMP_{50}$ and $EMP_{100}$ is set to "1", at least one of first control signals $CM10_{50}$, $CM10_{10}$, $CM10_5$, $CM50_{10}$, $CM50_2$ and $CM100_5$ from comparators 21a, 21b, 21c, 22a, 22b and 23 is input and second control signal CP500, CP10, CP50 or CP100 of comparator 31, 32, 33 or 34 is input, and outputs the paying-out signals to coin paying-out mechanism 16 and stored coin number counters $MS_{500}$, $MS_{10}$, $MS_{50}$ and $MS_{100}$. Coin return control unit 70 also outputs addition signals $MU_{500}$, $MU_{10}$, $MU_{50}$ and $MU_{100}$ to corresponding stored coin number counters $MS_{500}$, $MS_{10}$, $MS_{50}$ and $MS_{100}$ and subtraction signals $CD_{500}$, $CD_{10}$, $CD_{50}$ and $CD_{100}$ to corresponding deposited coin number counters $CT_{500}$, $CT_{10}$, $CT_{50}$ and $CT_{100}$.

The operation of the system shown in FIG. 13 will be explained with reference to flowcharts shown in FIG. 14–19. Here, all deposited coins are assumed to be acceptable coins.

Figure 8:
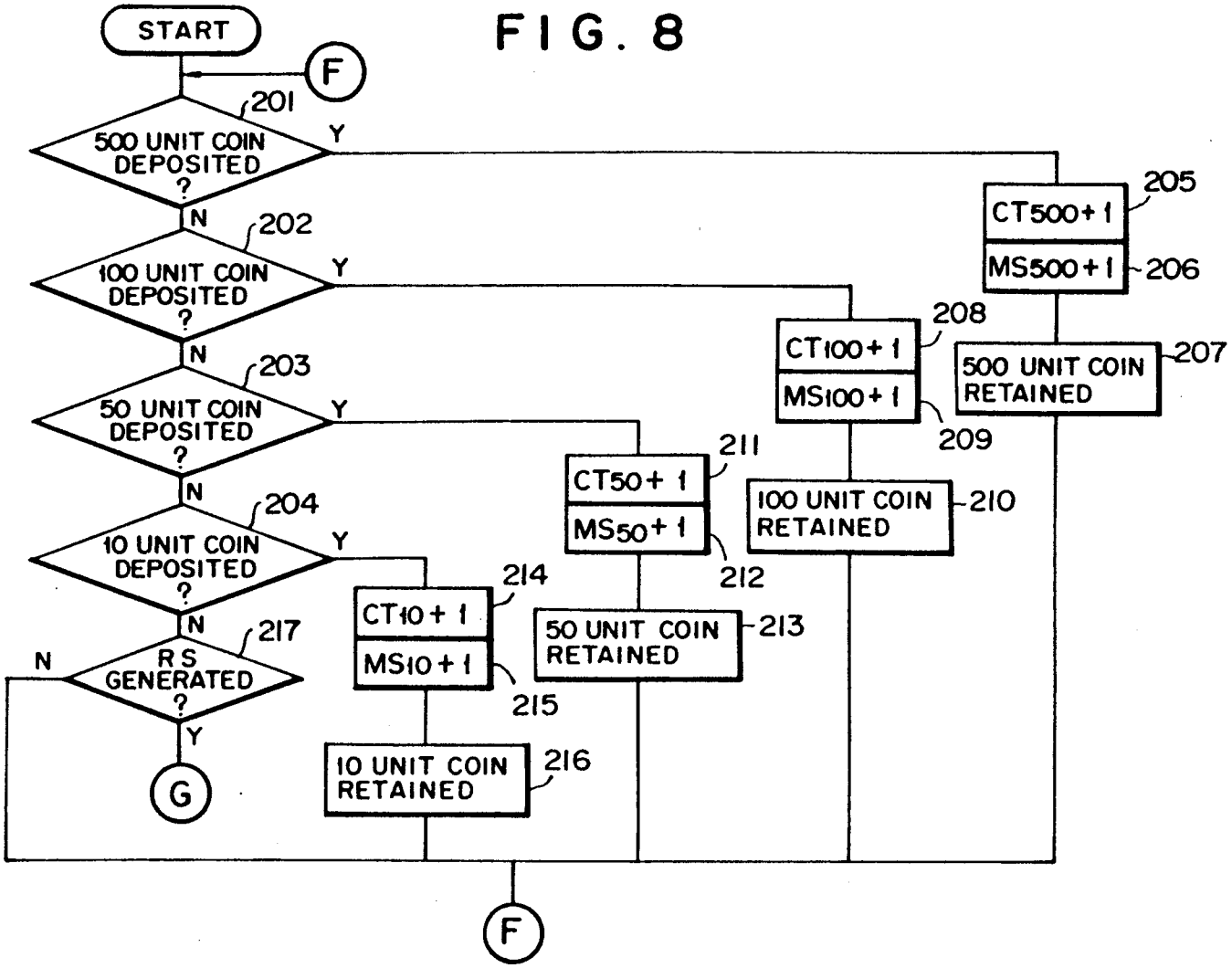
FIGS. 8 to 12 are flowcharts of the control system of FIG. 7.
Figure 14:
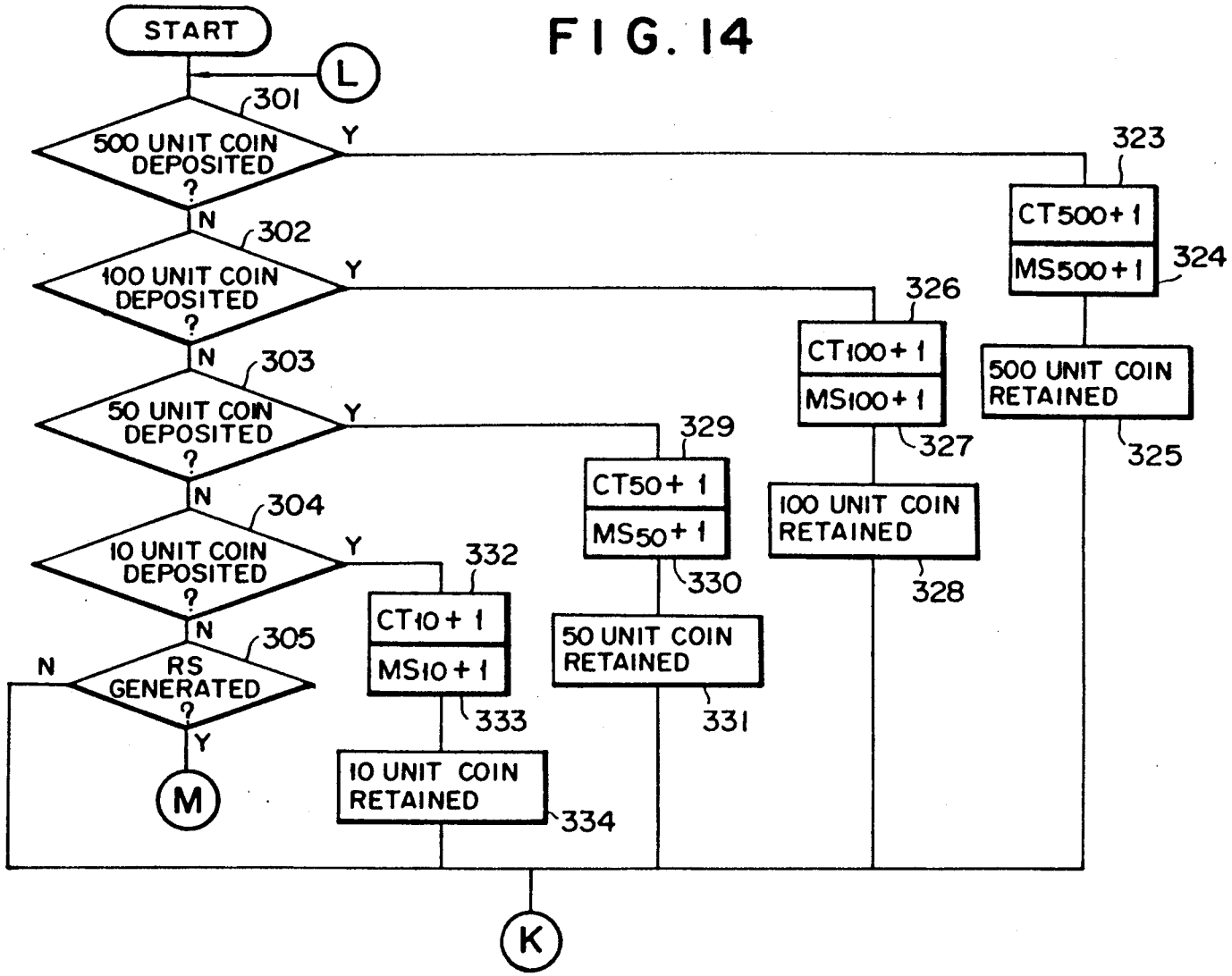
FIGS. 14 to 19 are flowcharts of the control system of FIG. 13.

The flow shown in FIG. 14 is substantially the same as the flow shown in FIG. 8. Namely, step 301 shown in FIG. 14 corresponds to step 201 shown in FIG. 8, step 302 to step 202, step 303 to step 203, step 304 to step 204, step 305 to step 217, step 323 to step 205, step 324 to step 206, step 325 to step 207, step 326 to step 208, step 327 to step 209, step 328 to step 210, step 329 to step 211, step 330 to step 212, step 331 to to step 213, step 332 to step 214, step 333 to step 215 and step 334 to step 216, respectively.

Figure 15:
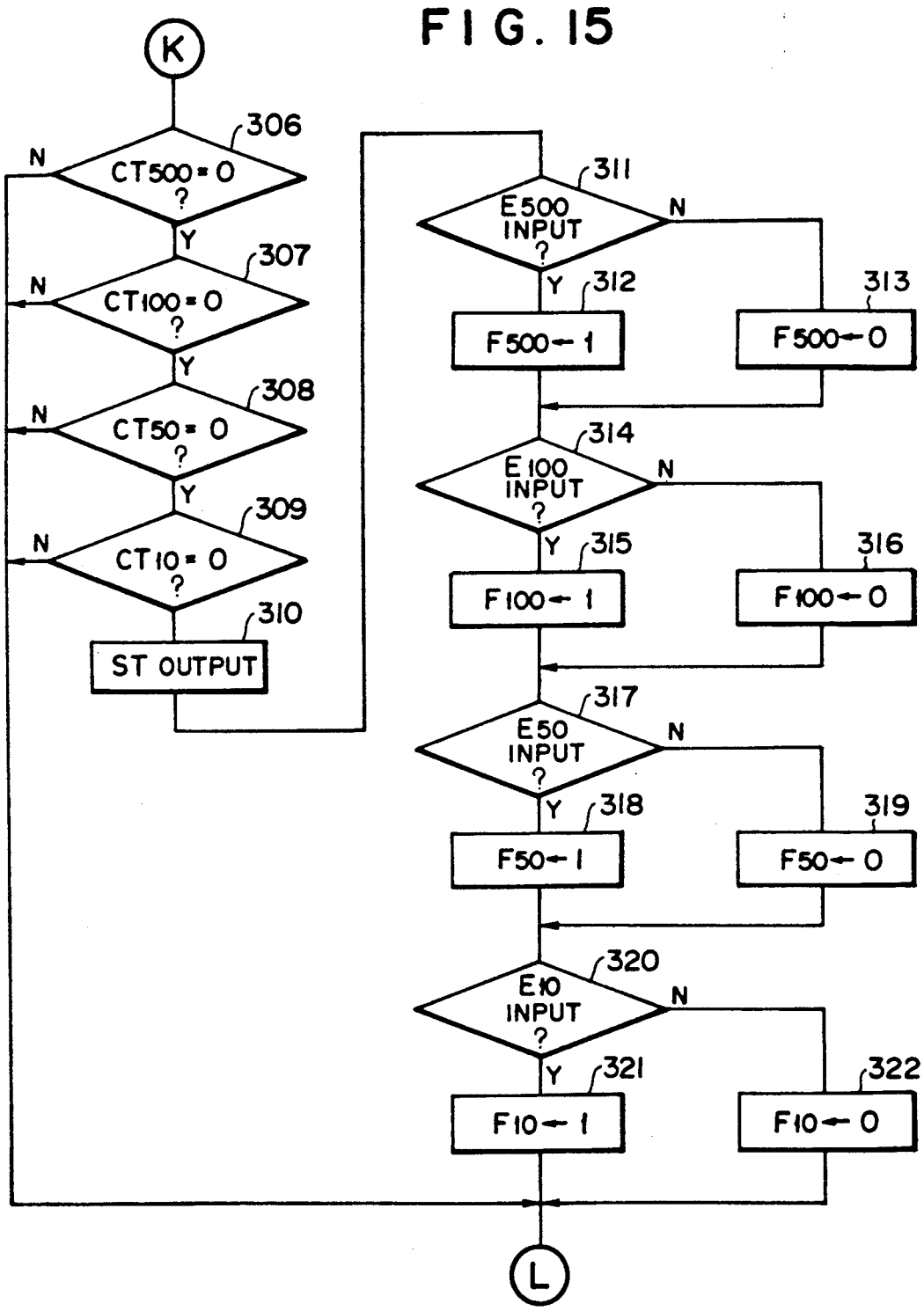

Flow proceeds to the operation shown in FIG. 15 from step 305, 325, 328, 331 or 334.

As shown in FIG. 15, memory signal generation means 40 determines whether each of the counted numbers of deposited coin number counters $CT_{500}$, $CT_{10}$, $CT_{50}$ and $CT_{100}$ is zero, by input counting signals $C_{500}$, $C_{10}$, $C_{50}$ and $C_{100}$ of the deposited coin number counters (steps 306–309). If the counted numbers of deposited coin number counters $CT_{500}$, $CT_{10}$, $CT_{50}$ and $CT_{100}$ are determined to be all zero at steps 306–309, memory signal generation means 40 outputs memory signal ST to change running-out memory means $EMP_{500}$, $EMP_{10}$, $EMP_{50}$ and $EMP_{100}$, respectively (step 310).

By input of memory signal ST, change running-out memory means $EMP_{500}$ for five hundred unit coins determines whether detecting signal $E_{500}$ of change running-out detecting means 12a is input (step 311), sets its flag $F_{500}$ to "1" if the detecting signal is determined to be input (step 312), and sets the flag to "0" if the detecting signal is determined not to be input (step 313). Change running-out memory means $EMP_{100}$ for one hundred unit coins determines whether detecting signal $E_{100}$ of change running-out detecting means 15a is input (step 314), sets its flag $F_{100}$ to "1" if the detecting signal is determined to be input (step 315), and sets the flag to "0" if the detecting signal is determined not to be input (step 316). Change running-out memory means $EMP_{50}$ for fifty unit coins determines whether detecting signal $E_{50}$ of change running-out detecting means 14a is input (step 317), sets its flag $F_{500}$ to "1" if the detecting signal is determined to be input (step 318), and sets its flag to "0" if the detecting signal is determined not to be input (step 319). Change running-out memory means $EMP_{10}$ for ten unit coins determines whether detecting signal $E_{10}$ of change running-out detecting means 13a is input (step 320), sets its flag $F_{10}$ to "1" if the detecting signal is determined to be input (step 321), and sets its flag to "0" if the detecting signal is determined not to be input (step 322). After the above operation, flow returns to step 301 in FIG. 14. If the counted number of any deposited coin number counter $CT_{500}$, $CT_{10}$, $CT_{50}$ or $CT_{100}$ is determined not to be zero at step 306, 307, 308 or 309, flow also returns to step 301.

After the above series of operations at steps 301–334, if coin return control unit 70 determines that return signal RS is generated by return signal generating means 100 when it is determined at steps 301–304 that no coins are deposited, flow proceeds to the operation shown in FIGS. 16–19.

Coin return control unit 70 determines by counting signal $C_{500}$ of deposited coin number counter $CT_{500}$ for five hundred unit coins whether the counted number of the deposited coin number counter is zero (step 335). If the counted number is determined to be zero at step 335, it is determined whether the counted number of stored coin number counter $MS_{500}$ for five hundred unit coins is greater than the predetermined initial value "2" and second control signal CP500 of comparator 31 of second comparison means 30 is input (step 336). If it is determined at step 336 that second control signal CP500 is input, it is determined whether flag $F_{100}$ of change running-out memory means $EMP_{100}$ for one hundred unit coins is set to "1" (step 337).

If it is determined that flag $F_{100}$ is set to "1" at step 337, it is determined whether the counted number of deposited coin number counter $CT_{100}$ is not less than threshold number TH $100_5$ (=5) and first control signal $CM100_5$ of comparator 23 of first comparison means 20 is input or not (step 338).

If it is determined that flag $F_{100}$ is not set to "1" (set to "0") at step 337 or that first control signal $CM100_5$ is not input at step 338, it is determined whether flag $F_{50}$ of change running-out memory means $EMP_{50}$ for fifty unit coins is set to "1" (step 339). If flag $F_{50}$ is set to "1", it is determined whether the counted number of deposited coin number counter $CT_{50}$ is not less than threshold number $TH50_{10}$ (=10) and first control signal $CM50_{10}$ of comparator 22*a* is input (step 340).

If it is determined that flag $F_{50}$ is not set to "1" at step 339 or that first control signal $CM50_{10}$ is not input at step 340, it is determined whether flag $F_{10}$ of change running-out memory means $EMP_{10}$ for ten unit coins is set to "1" (step 341). If flag $F_{10}$ is set to "1", it is determined whether the counted number of deposited coin number counter $CT_{10}$ is not less than threshold number $TH10_{50}$ (=50) and first control signal $CM10_{50}$ of comparator 21*a* is input (step 342).

On the other hand, if it is determined that the counted number of deposited coin number counter $CT_{500}$ is not zero at step 335, that first control signal $CM100_5$ is input at step 338, that first control signal $CM50_{10}$ is input at step 340, or that first control signal $CM10_{50}$ is input at step 342, coin return control unit 70 outputs paying-out signal $P_{500}$ to coin paying-out mechanism 16 and stored coin number counter $MS_{500}$. According to this $P_{500}$ signal, a five hundred unit coin is returned from change retaining tube 12 for five hundred unit coins to return opening 11 (step 343), and the counted number of stored coin number counter $MS_{500}$ is decremented by one (step 344).

Thereafter, coin return control unit 70 determines whether detecting signal $E_{500}$ of change running-out detecting means 12*a* is input (step 345). If detecting signal $E_{500}$ is determined to be input at step 345, it is determined whether second control signal CP500 of comparator 31 of second comparison means 30 is input (step 346). If the second control signal CP500 is input, the counted number of stored coin number counter $MS_{500}$ is determined to be "2" (step 347).

After the determination at step 347, or if it is determined that detecting signal $E_{500}$ is not input at step 345 or that second control signal CP500 is not input at step 346, it is determined whether the counted number of deposited coin number counter $CT_{500}$ for five hundred unit coins is zero (step 348). If the counted number is not zero, subtraction signal $CD_{500}$ is output to deposited coin number counter $CT_{500}$ to subtract one from the counted number. This causes deposited coin number counter $CT_{500}$ to be decremented by one (step 349), and control returns to step 335.

If the counted number of deposited coin number counter $CT_{500}$ is determined to be zero at step 348, it is determined whether first control signal $CM100_5$ is input (step 350). If first control signal $CM100_5$ is input, subtraction signal $CD_{100}$ is output to deposited coin number counter $CT_{100}$ to subtract five from its counted number, and addition signal $MU_{100}$ is output to stored coin number counter $MS_{100}$ to add five to its counted number. This causes deposited coin number counter $CT_{100}$ to be decremented by five (step 351) and stored coin number counter $MS_{100}$ to be incremented by five (step 352), and control returns to step 335.

If first control signal $CM100_5$ is determined not to be input at step 350, it is determined whether first control signal $CM50_{10}$ is input (step 353). If first control signal $CM50_{10}$ is input, subtraction signal $CD_{50}$ is output to deposited coin number counter $CT_{50}$ to subtract ten from its counted number, and addition signal $MU_{50}$ is output to stored coin number counter $MS_{50}$ to add ten to its counted number. This causes deposited coin number counter $CT_{50}$ to be decremented by ten (step 354) and stored coin number counter $MS_{50}$ to be incremented by ten (step 355), and control returns to step 335.

If first control signal $CM50_{10}$ is determined not to be input at step 353, subtraction signal $CD_{10}$ is output to deposited coin number counter $CT_{10}$ to subtract fifty from its counted number, and addition signal $MU_{10}$ is output to stored coin number counter $MS_{10}$ to add fifty to its counted number. This causes deposited coin number counter $CT_{10}$ to be decremented by fifty (step 356) and stored coin number counter $MS_{10}$ to be incremented by fifty (step 357), and control returns to step 335.

Figure 17:
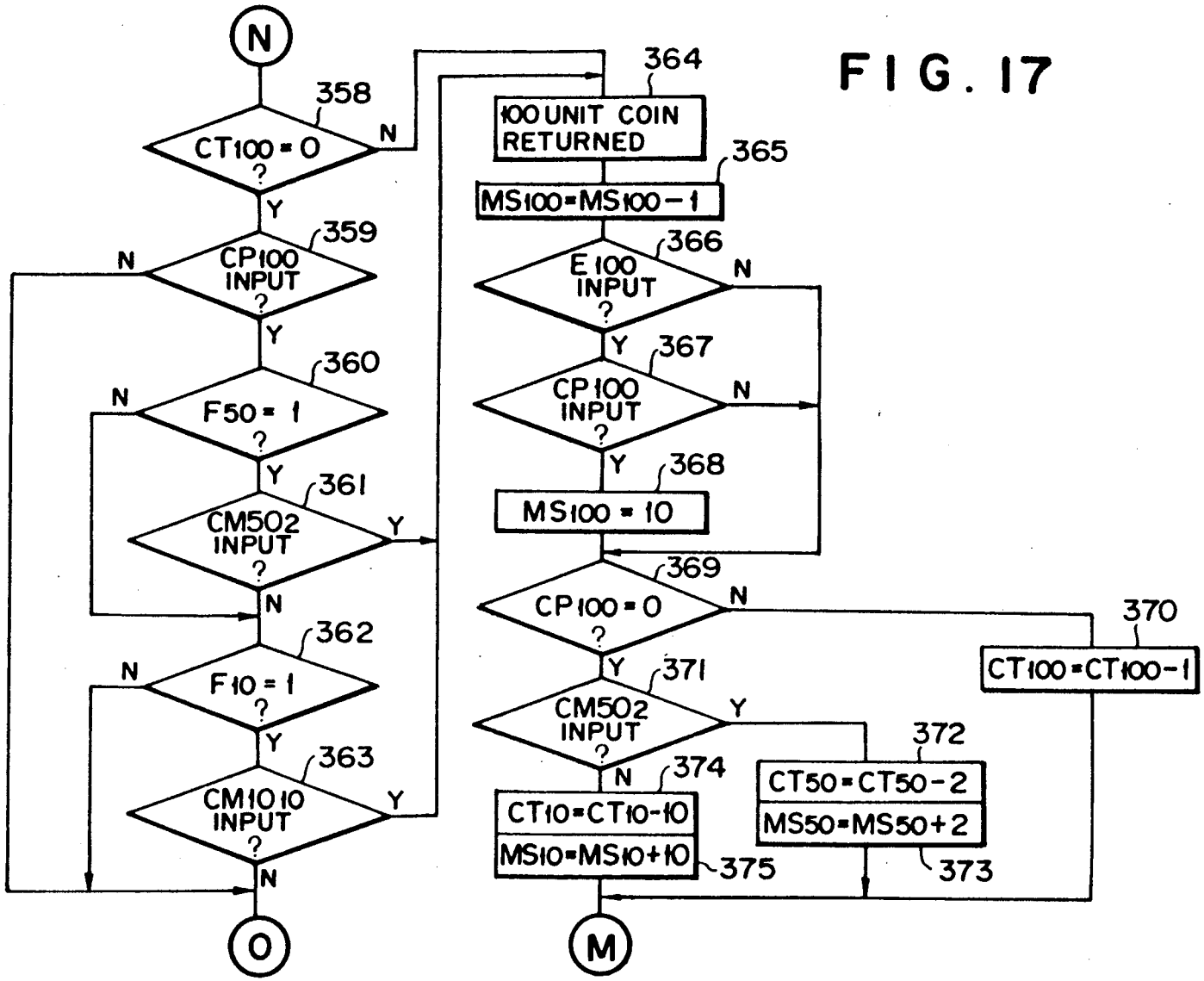

If it is determined that second control signal CP500 is not input at step 336, that flag $F_{10}$ is not set to "1" at step 341, or that first control signal $CM10_{50}$ is not input at step 342, control proceeds to the operation shown in FIG. 17.

As shown in FIG. 17, coin return control unit 70 determines whether the counted number of deposited coin number counter $CT_{100}$ is zero or not, based on counting signal $C_{100}$ of the deposited coin number counter (step 358). If the counted number is determined to be zero at step 358, it is determined whether the counted number of stored coin number counter $MS_{100}$ for one hundred unit coins is greater than its predetermined initial value and second control signal CP100 of comparator 34 of second comparison means 30 is input (step 359). If second control signal CP100 is determined to be input at step 359, it is determined whether flag $F_{50}$ of change running-out memory means $EMP_{50}$ for fifty unit coins is set to "1" (step 360).

If flag $F_{50}$ is determined to be set to "1" at step 360, it is determined whether the counted number of deposited coin number counter $CT_{50}$ for fifty unit coins is not less than threshold value $TH50_2$ (=2) and first control signal $CM50_2$ of comparator 22*b* of first comparison means 20 is input (step 361).

If it is determined that flag $F_{50}$ is not set to "1" at step 360 or that first control signal $CM50_2$ is not input at step 361, it is determined whether flag $F_{10}$ of change running-out memory means $EMP_{10}$ for ten unit coins is input (step 362). If flag $F_{10}$ is set to "1" it is determined whether the counted number of deposited coin number counter $CT_{10}$ is not less than threshold number $TH10_{10}$ (=10) and first control signal $CM10_{10}$ of comparator 21*b* is input (step 363).

On the other hand, if it is determined that the counted number of deposited coin number counter $CT_{100}$ is not zero at step 358, that first control signal $CM50_2$ is input at step 361, or that first control signal $CM10_{10}$ is input at step 363, coin return control unit 70 outputs paying-out signal $P_{100}$ to coin paying-out mechanism 16 and stored coin number counter $MS_{100}$. According to this signal $P_{100}$, a one hundred unit coin is returned from change retaining tube 15 for one hundred unit coins to return opening 11 (step 364), and the counted number of stored coin number counter $MS_{100}$ is decremented by one (step 365).

Thereafter, coin return control unit 70 determines whether detecting signal $E_{100}$ of change running-out detecting means 15*a* is input (step 366). If detecting signal $E_{100}$ is determined to be input at step 366, it is determined whether second control signal CP100 of comparator 34 of second comparison means 30 is input (step 367). If the second control signal CP100 is input, the counted number of stored coin number counter $MS_{100}$ is determined to be "10" (step 368).

After the determination at step 368, or if it is determined that detecting signal $E_{100}$ is not input at step 366 or that second control signal CP100 is not input at step 367, it is determined whether the counted number of deposited coin number counter $CT_{100}$ for one hundred unit coins is zero (step 369). If the counted number is not zero, subtraction signal $CD_{100}$ is output to deposited coin number counter $CT_{100}$ to subtract one from the counted number. This causes deposited coin number counter $CT_{100}$ to be decremented by one (step 370), and control returns to step 335.

If the counted number of deposited coin number counter $CT_{100}$ is determined to be zero at step 369, it is determined whether first control signal $CM50_2$ is input (step 371). If first control signal $CM50_2$ is input, subtraction signal $CD_{50}$ is output to deposited coin number counter $CT_{50}$ to subtract two from its counted number, and addition signal $MU_{50}$ is output to stored coin number counter $MS_{50}$ to add two to its counted number. This causes deposited coin number counter $CT_{50}$ to be decremented by two (step 372) and stored coin number counter $MS_{50}$ to be incremented by two (step 373), and control returns to step 335.

If first control signal $CM50_2$ is determined not to be input at step 371, subtraction signal $CD_{10}$ is output to deposited coin number counter $CT_{10}$ to subtract ten from its counted number, and addition signal $MU_{10}$ is output to stored coin number counter $MS_{10}$ to add ten to its counted number. This causes deposited coin number counter $CT_{10}$ to be decremented by ten (step 374) and stored coin number counter $MS_{10}$ to be incremented by ten (step 375), and control returns to step 335.

Figure 18:
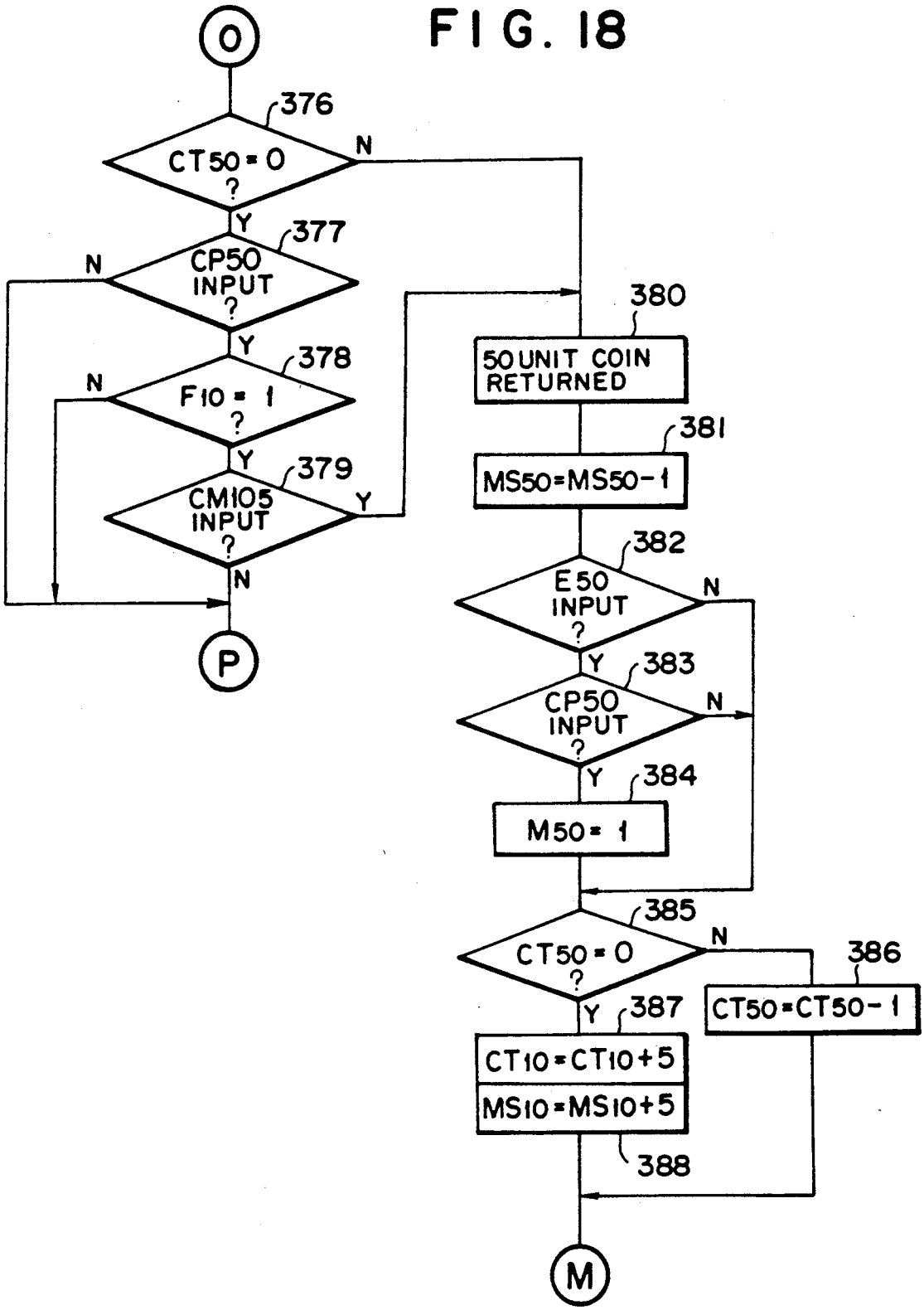

If it is determined that second control signal CP100 is not input at step 359, that flag $F_{10}$ is not set to "1" at step 362, or that first control signal $CM10_{10}$ is not input at step 363, control proceeds to the operation shown in FIG. 18.

Coin return control unit 70 determines whether the counted number of deposited coin number counter $CT_{50}$ is zero or not, by counting signal $C_{50}$ of the deposited coin number counter (step 376). If the counted number is determined to be zero at step 376, it is determined whether the counted number of stored coin number counter $MS_{50}$ for fifty unit coins is greater than its predetermined initial value and second control signal CP50 of comparator 33 of second comparison means 30 is input (step 377). If second control signal CP50 is determined to be input at step 377, it is determined whether flag $F_{10}$ of change running-out memory means $EMP_{10}$ for ten unit coins is set to "1" (step 378).

If flag $F_{10}$ is determined to be set to "1" at step 378, it is determined whether the counted number of deposited coin number counter $CT_{10}$ for ten unit coins is not less than threshold value $TH10_5$ (=5) and first control signal $CM10_5$ of comparator 21*c* of first comparison means 20 is input (step 379).

Figure 19:
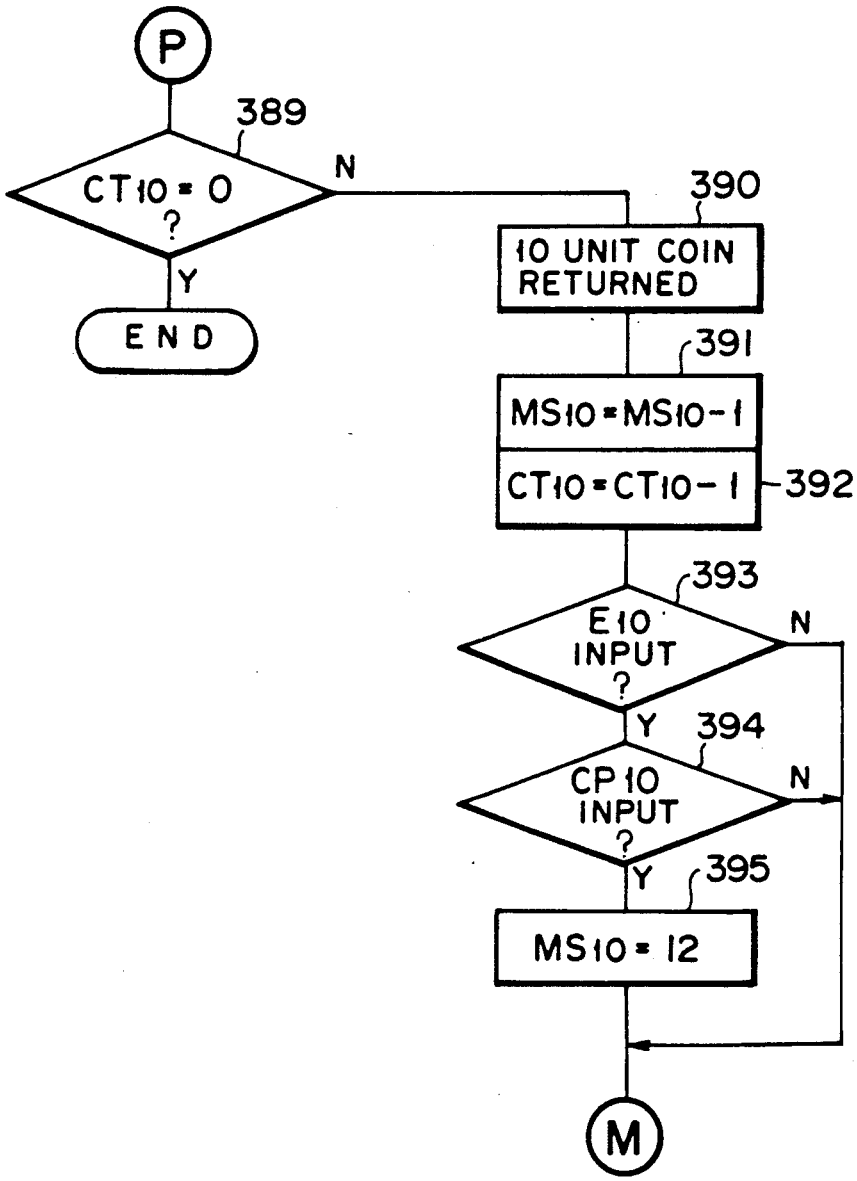

If it is determined that first control signal $CM10_5$ is not input at step 379, that second control signal CP50 is not input at step 377 or that flag $F_{10}$ is not set to "1" at step 378, control proceeds to the operation shown in FIG. 19.

On the other hand, if it is determined that the counted number of deposited coin number counter $CT_{50}$ is not zero at step 376 or that first control signal $CM10_5$ is input at step 379, coin return control unit 70 outputs paying-out signal $P_{50}$ to coin paying-out mechanism 16 and stored coin number counter $MS_{50}$. According to this $P_{50}$ signal, a fifty unit coin is returned from change retaining tube 14 for fifty unit coins to return opening 11 (step 380), and the counted number of stored coin number counter $MS_{50}$ is decremented by one (step 381).

Thereafter, coin return control unit 70 determines whether detecting signal $E_{50}$ of change running-out detecting means 14*a* is input (step 382). If detecting signal $E_{50}$ is determined to be input at step 392, it is determined whether second control signal CP50 of comparator 33 of second comparison means 30 is input (step 383). If the second control signal CP50 is input, the counted number of stored coin number counter $MS_{50}$ is determined to be "10" (step 384).

After the determination at step 384, or if it is determined that detecting signal $E_{50}$ is not input at step 382 or that second control signal CP50 is not input at step 383, it is determined whether the counted number of deposited coin number counter $CT_{50}$ for fifty unit coins is zero (step 385). If the counted number is not zero, subtraction signal $CD_{50}$ is output to deposited coin number counter $CT_{50}$ to subtract one from the counted number. This causes deposited coin number counter $CT_{50}$ to be decremented by one (step 386), and control returns to step 385.

If the counted number of deposited coin number counter $CT_{50}$ is determined to be zero at step 385, subtraction signal $CD_{10}$ is output to deposited coin number counter $CT_{10}$ to subtract five from its counted number, and addition signal $MU_{10}$ is output to stored coin number counter $MS_{10}$ to add five to its counted number. This causes deposited coin number counter $CT_{10}$ to be decremented by five (step 387) and stored coin number counter $MS_{10}$ to be incremented by five (step 388), and control returns to step 335.

If it is determined that second control signal CP50 is not input at step 377, that flag $F_{10}$ is not set to "1" at step 378, or that first control signal $CM10_5$ is not input at step 379, flow proceeds to the operation shown in FIG. 19.

As shown FIG. 19 coin return control unit 70 determines whether the counted number of deposited coin number counter $CT_{10}$ is zero or not, based on counting signal $C_{10}$ of the deposited coin number counter (step 389). If the counted number is determined to be zero at step 389, coin return control unit 70 outputs paying-out signal $P_{10}$ to coin paying-out mechanism 16 and stored coin number counter $MS_{10}$ and outputs subtraction signal $CD_{10}$ to deposited coin number counter $CT_{10}$. According to this signal $P_{10}$, a ten unit coin is returned from change retaining tube 13 for ten unit coins to return opening 11 (step 390), and the counted number of stored coin number counter $MS_{10}$ is decremented by one (step 391) and deposited coin number counter $CT_{10}$ is also decremented by one (step 392).

Thereafter, coin return control unit 70 determines whether detecting signal $E_{10}$ of change running-out detecting means 13*a* is input (step 393). If detecting signal $E_{10}$ is determined to be input at step 393, it is determined whether second control signal CP10 of comparator 32 of second comparison means 30 is input (step 394). If the second control signal CP10 is input, the counted number of stored coin number counter $MS_{10}$ is determined to be "12" (step 395).

Figure 16:
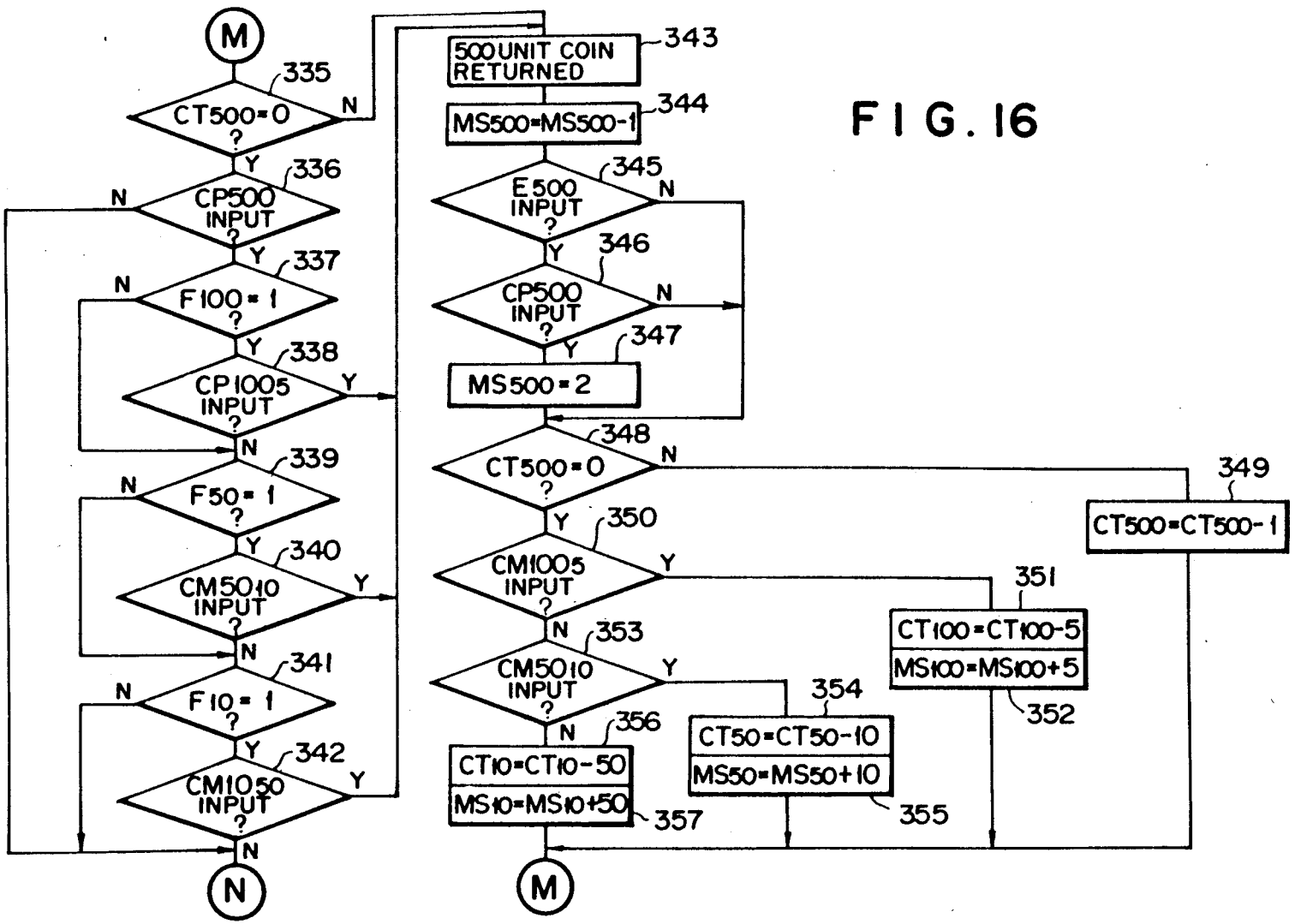

After the determination at step 395, or if it is determined that detecting signal $E_{10}$ is not input at step 393 or that second control signal CP10 is not input at step 394, control returns to step 335 shown in FIG. 16.

On the other hand, if the counted number is determined to be zero at step 389, the operation of the coin return control is finished.

In the third embodiment, the relatively larger denomination coin is adequately returned instead of the relatively smaller denomination coins, only when the smaller denomination coin is in its change running-out state and the state is memorized. Therefore, the chance for a vending machine sale can be increased, and the use of the vending machine as a coin exchange machine can be adequately prevented.

Although several preferred embodiments of the present invention have been described herein in detail, it will be appreciated by those skilled in the art that various modifications and alterations can be made to these embodiments without materially departing from the novel teachings and advantages of this invention. Accordingly, it is to be understood that all such modifications and alterations are included within the scope of this invention as defined by the following claims.

What is claimed is:

1. A coin return control system for vending machines comprising:

coin testing means for testing the authenticity and type of deposited coins including relatively smaller denomination coins and relatively larger denomination coins;

a plurality of deposited coin counter means responsive to said coin testing means for counting the number of each type of deposited coin;

a plurality of change retaining means for retaining each type of deposited coin;

coin paying-out means for paying out coins from said change retaining means according to paying-out signals;

a plurality of change running-out detecting means, each corresponding to a particular type of coin, for detecting whether the number of coins retained in particular change retaining means has reached a number not less than predetermined number and for generating a change running-out detecting signal;

return signal generating means for generating a coin return signal;

comparison means for comparing a first value corresponding to the number of relatively smaller denomination coins counted by a corresponding coin counter with a second value corresponding to the number of the smaller denomination coins that corresponds to a denomination of a larger denomination coin, and for generating a control signal if the first value is not less than the second value; and coin return control means for generating a paying-out signal to cause a larger denomination coin to be returned instead of smaller denomination coins if, when said coin return signal is generated, 1) a change running-out detecting signal from a change running-out detecting means corresponding to a smaller denomination coin is generated, 2) said control signal is generated and 3) a change running-out detecting signal from a change running-out detecting means corresponding to a larger denomination coin is not generated; and means for outputting said paying-out signal to said coin paying-out means.

2. A coin return control system for vending machines comprising:

a coin testing means for testing the authenticity and type of deposited coins including relatively smaller denomination coins and relatively larger denomination coins;

a plurality of deposited coin counter means responsive to said coin testing means for counting the number of each type of deposited coin;

a plurality of change retaining means for retaining each type of deposited coin;

a coin paying-out means for paying out coins from said change retaining means according to paying-out signals;

a plurality of change running-out detecting means, each corresponding to a particular type of coin, for detecting whether the number of coins retained in particular change retaining means has reached a number not less than a predetermined number and for generating a change running-out detecting signal;

a plurality of stored coin counter means responsive to said coin testing means, each of which is set to a predetermined initial value based on a signal from a corresponding change running-out detecting means, for adding the number of coins deposited into a corresponding change retaining means to a prior number of coins previously retained in said change retaining means and for subtracting the number of coins paid out by said coin paying-out means from a prior number of coins retained in the change retaining means based on said paying-out signals;

return signal generating means for generating a coin return signal;

first comparison means for comparing a first value corresponding to the number of relatively smaller denomination coins counted by a corresponding coin counter with a second value corresponding to the number of smaller denomination coins that corresponds to a denomination of a larger denomination coin, and for generating a first control signal if the first value is not less than the second value;

second comparison means for comparing a third value corresponding to a number counted by a stored coin counter means with a fourth value corresponding to said predetermined initial value of the stored coin number counter, and generating a second control signal if the third value is greater than the fourth value; and coin return control means for generating a paying-out signal to cause a larger denomination coin to be returned instead of a small denomination coins if, when said coin return signal is generated, 1) a change running-out detecting signal from a change running-out detecting means corresponding to a smaller denomination coin is generated, 2) said control signal is generated and 3) a change running-out detecting signal by another of said change running-out detecting means corresponding to a larger denomination coin is not generated;

and means for outputting said paying-out signal to coin paying-out means and said stored coin counter means.

3. A coin return control system for vending machines comprising:

coin testing means for testing the authenticity and type of deposited coins including relatively smaller denomination coins and relatively larger denomination coins;

a plurality of deposited coin counter means responsive to said coin testing means for counting the number of each type of deposited coin;

a plurality of change retaining means for retaining each type of deposited coin;

coin paying-out means for paying out coins from said change retaining means according to paying-out signals;

a plurality of change running-out detecting means, each corresponding to a particular type of coin, for detecting whether the number of coins retained in particular change retaining means has reached a number not less than a predetermined number and for generating a change running-out detecting signal;

a plurality of stored coin counter means responsive to said coin testing means each of which is set to a predetermined initial value based on a signal from a corresponding change running-out detecting means, for adding the number of coins deposited into a corresponding change retaining means to a prior number of coins previously retained in the change retaining tube, and for subtacting the number of coins paid out by said coin paying-out means from a prior number of coins retained in the change retaining means based on said paying-out signals;

return signal generating means for generating a coin return signal;

a plurality of change running-out memory means each of which memorizes the change running-out state of a corresponding type of coin if said change running-out detecting signal of a corresponding change running-out detecting means is generated when the counted number of all said deposited coin counter means is at a set of initial values;

first comparison means for comparing a first value corresponding to the number of relatively smaller denomination coins counted by a corresponding coin counter means with a second value corresponding to the number of the smaller denomination coins that corresponds to a denomination of a larger denomination coin, and for generating a first control signal if the first value is not less than the second value;

second comparison means for comparing a third value corresponding to a number counted by a stored coin counter means with a fourth value corresponding to said predetermined initial value of the stored coin number counter, and generating a second control signal if the third value is greater than the fourth value;

coin return control means for generating a paying-out signal to return a larger denomination coin instead of smaller denomination coins if, when said return signal is generated, 1) said change running-out memory means memorizes the change running-out state of a smaller denomination coin, 2) said first control signal is generated and 3) said second control signal corresponding to a relatively larger denomination coin is generated; and means for outputting the paying-out signal to said coin paying-out means and said stored coin counter means, and for outputting addition and subtraction signals to corresponding stored coin counter means and the corresponding deposited coin counter means to add the number of the smaller denomination coins corresponding to a returned substituted larger denomination coin to the respective stored coin counter means for the smaller denomination coins and to subtract said number from the corresponding coin counter means.

* * * * *